US011713628B2

(12) United States Patent
Martin et al.

(10) Patent No.: US 11,713,628 B2
(45) **Date of Patent: *Aug. 1, 2023**

(54) WHEEL ASSEMBLY

(71) Applicant: Impact Selector International, LLC, Heath, TX (US)

(72) Inventors: Brandon Martin, Forney, TX (US); James Patrick Massey, Leadville, CO (US)

(73) Assignee: Impact Selector International, LLC, Heath, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/933,375

(22) Filed: Sep. 19, 2022

(65) Prior Publication Data

US 2023/0008162 A1 Jan. 12, 2023

Related U.S. Application Data

(63) Continuation of application No. 17/249,643, filed on Mar. 8, 2021, now Pat. No. 11,536,093.

(60) Provisional application No. 62/987,309, filed on Mar. 9, 2020.

(51) Int. Cl.
*E21B 17/10* (2006.01)

(52) U.S. Cl.
CPC ..... *E21B 17/1057* (2013.01)

(58) Field of Classification Search
CPC ..... E21B 17/1057; E21B 23/001
See application file for complete search history.

(56) References Cited

U.S. PATENT DOCUMENTS

| | | | | |
|---|---|---|---|---|
| 4,445,791 | A | 5/1984 | Klima | |
| 4,620,802 | A | 11/1986 | Harrel | |
| 9,488,224 | B1 | 11/2016 | Castro | |
| 11,536,093 | B2 * | 12/2022 | Martin | E21B 17/1057 |
| 2008/0164018 | A1 | 7/2008 | Hall | |
| 2012/0145380 | A1 | 6/2012 | Draper et al. | |
| 2012/0222857 | A1 | 9/2012 | McNay | |
| 2012/0255744 | A1 * | 10/2012 | Shaikh | E21B 17/1057 166/241.1 |

(Continued)

FOREIGN PATENT DOCUMENTS

| | | | | |
|---|---|---|---|---|
| WO | 2017141047 | A1 | 8/2017 | |
| WO | WO-2017141047 | A1 * | 8/2017 | E21B 17/1057 |
| WO | 2021184036 | A1 | 9/2021 | |

OTHER PUBLICATIONS

Written Opinion of the ISA and International Search Report dated Jun. 8, 2021, 10 pages.

*Primary Examiner* — Theodore N Yao
(74) *Attorney, Agent, or Firm* — Boisbrun Hofman, PLLC

(57) ABSTRACT

A wheel assembly configured to detachably connect to a downhole tool to thereby reduce friction between the downhole tool and a sidewall of a wellbore through which the downhole tool is conveyed. The wheel assembly may include an axle configured to contact a sidewall of the downhole tool, wherein the axle comprises a bore extending therethrough, a wheel rotatably connected to the axle such that the wheel extends around at least a portion of the axle and the bore, and a fastener configured to be disposed at least partially within the bore and extend out of the bore into the sidewall of the downhole tool to detachably connect the axle to the downhole tool.

20 Claims, 12 Drawing Sheets

(56) References Cited

U.S. PATENT DOCUMENTS

| | | | | |
|---|---|---|---|---|
| 2015/0226037 | A1* | 8/2015 | Hradecky | E21B 23/14 166/241.1 |
| 2018/0363423 | A1* | 12/2018 | Hradecky | E21B 47/09 |
| 2021/0002966 | A1* | 1/2021 | Church | E21B 17/1057 |
| 2021/0277725 | A1 | 9/2021 | Martin et al. | |

* cited by examiner

WHEEL ASSEMBLY

CROSS-REFERENCE TO RELATED APPLICATIONS

This application claims priority to and the benefit of U.S. patent application Ser. No. 17/249,643, titled "WHEEL ASSEMBLY," filed on Mar. 8, 2021, which claims priority to and the benefit of U.S. Provisional Patent Application No. 62/987,309, titled "WHEEL ASSEMBLY," filed Mar. 9, 2020, the entire disclosures of which are hereby incorporated herein by reference.

BACKGROUND OF THE DISCLOSURE

Wells are generally drilled into land surface or ocean bed to recover natural deposits of oil and gas, and other natural resources that are trapped in subterranean rock formations in the Earth's crust. Testing and evaluation of completed and partially finished wells has become commonplace, such as to increase well production and return on investment. Downhole measurements of formation pressure, formation permeability, and recovery of formation fluid samples, may be useful for predicting economic value, production capacity, and production lifetime of geological formations. Completion and stimulation operations of wells, such as perforating and fracturing operations, may also be performed to optimize well productivity. Plugging and perforating tools may be utilized to set plugs within a wellbore to isolate portions of the wellbore and rock formations surrounding the wellbore from each other and to perforate the well in preparation for fracturing. Each fracturing stage interval along the wellbore can be perforated with one or more perforating tools forming one or more clusters of perforation tunnels along the wellbore. Intervention operations in completed wells, such as installation, removal, or replacement of various production equipment, may also be performed as part of well repair or maintenance operations or permanent abandonment. Such testing, completion, intervention, and other downhole operations have become complicated, as wellbores are drilled deeper and often include extensive horizontal or otherwise non-vertical (i.e., deviated) portions.

Downhole tools that have conventionally been used in vertical and near-vertical wellbores may encounter problems when used in non-vertical portions of a wellbore. Such downhole tools may be lowered into a wellbore as part of a tool string utilizing gravity to facilitate transport or movement therethrough. In non-vertical wellbores, gravity may be negated by frictional forces between the tool string and sidewalls of the wellbore, thus resisting movement of the tool string through the wellbore.

In addition to the increased friction due to an increased horizontal gradient, movement of a tool string along a non-vertical portion of a wellbore may be impeded further by the presence of various obstacles. For example, washouts, sharp bends, misaligned tubular joins, transitions between lining, casing, and bare sidewalls of the wellbore, and other uneven surfaces may present an increased resistance or impediments to the movement of the tool string through the wellbore. Furthermore, particularly with openhole wellbores not lined with a casing, outer surface of the tool string may stick to the sidewall of the wellbore, or an edge of the tool string may dig into or jam against imperfections along the sidewall of the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
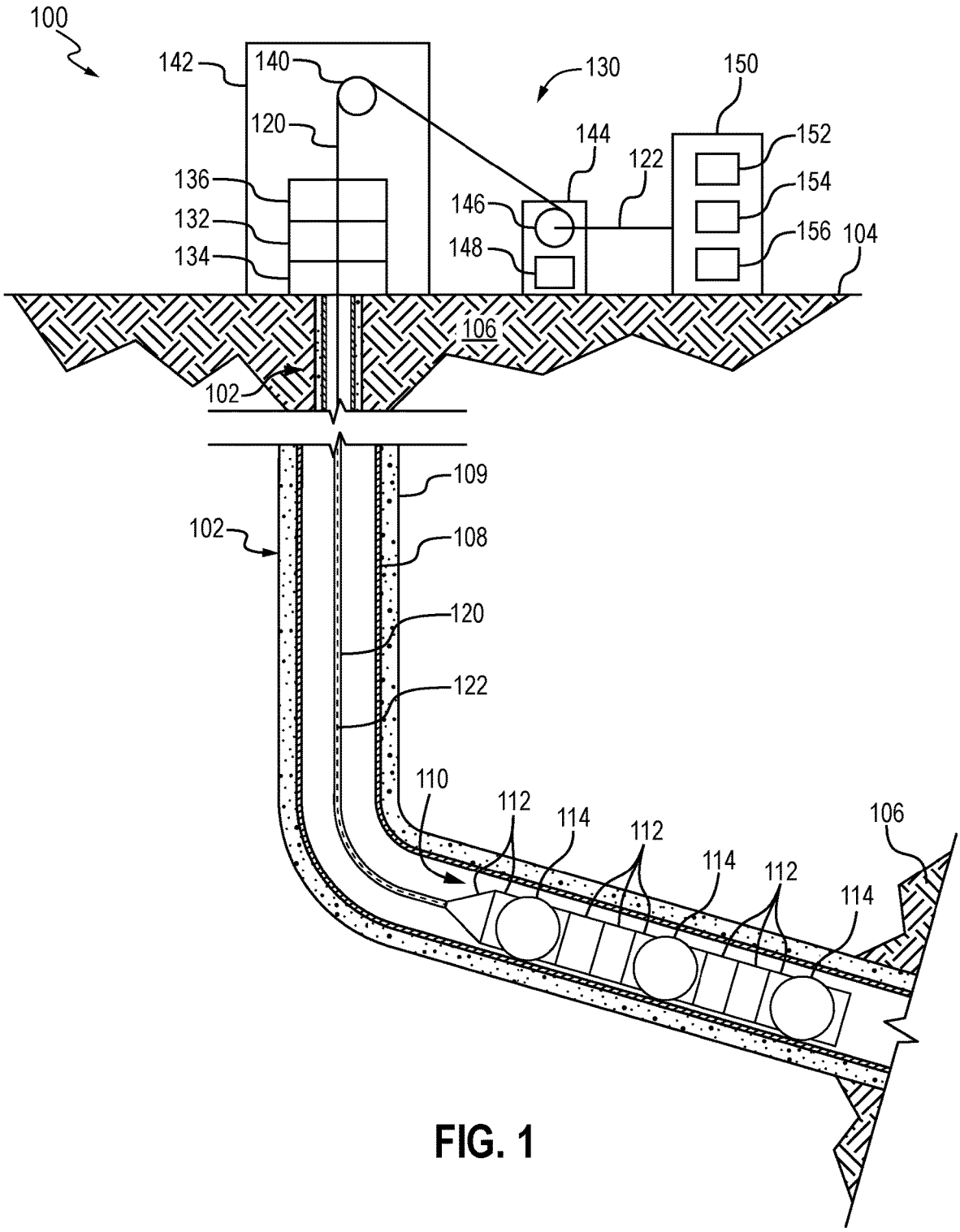
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Terms, such as upper, upward, above, lower, downward, and/or below are utilized herein to indicate relative positions and/or directions between apparatuses, tools, components, parts, portions, members and/or other elements described herein, as shown in the corresponding figures. Such terms do not necessarily indicate relative positions and/or directions when actually implemented. Such terms, however, may indicate relative positions and/or directions with respect to a wellbore when an apparatus according to one or more aspects of the present disclosure is utilized or otherwise disposed within the wellbore. For example, the term upper may mean in the uphole direction, and the term lower may mean in the downhole direction.

FIG. 1 is a schematic view of at least a portion of an example implementation of a wellsite system 100 according to one or more aspects of the present disclosure, representing an example environment in which one or more aspects of the present disclosure may be implemented. The wellsite system 100 is depicted in relation to a wellbore 102 formed by rotary and/or directional drilling and extending from a wellsite surface 104 into a subterranean formation 106. A lower portion of the wellbore 102 is shown enlarged compared to an upper portion of the wellbore 102 adjacent the wellsite surface 104 to permit a larger and therefore a more detailed depiction of various tools, tubulars, devices, and other objects disposed within the wellbore 102. The wellsite system 100 may be utilized to facilitate recovery of oil, gas, and/or other materials that are trapped in the subterranean formation 106 via the wellbore 102. At least a portion of the wellbore 102 may be a cased-hole wellbore 102 comprising a casing 108 secured by cement 109, and/or a portion of the wellbore 102 may be an open-hole wellbore 102 lacking the casing 108 and cement 109. The wellbore 102 may also or instead contain a fluid conduit (e.g., a production tubing) (not shown) disposed within at least a portion of the casing 108 and/or an open-hole portion of the wellbore 102. Thus, one or more aspects of the present disclosure are applicable to and/or readily adaptable for utilizing in a cased-hole portion of the wellbore 102, an open-hole portion of the wellbore 102, and/or a fluid conduit disposed within a cased-hole and/or open-hole portion of a wellbore 102. It is also noted that although the wellsite system 100 is depicted as an onshore implementation, it is to be understood that the aspects described below are also generally applicable to offshore implementations.

The wellsite system 100 includes surface equipment 130 located at the wellsite surface 104. The wellsite system 100 also includes or is operable in conjunction with a downhole intervention and/or sensor assembly, referred to as a tool string 110, conveyed within the wellbore 102 via a conveyance line 120 operably connected with one or more pieces of the surface equipment 130. The conveyance line 120 may be operably connected with a conveyance device 140 operable to apply an adjustable downward- and/or upward-directed force to the tool string 110 via the conveyance line 120 to convey the tool string 110 within the wellbore 102. The conveyance line 120 may be or comprise coiled tubing, a cable, a wireline, a slickline, a multiline, or an e-line, among other examples. The conveyance device 140 may be, comprise, or form at least a portion of a sheave or pulley, a winch, a draw-works, an injector head, and/or another device coupled to the tool string 110 via the conveyance line 120. The conveyance device 140 may be supported above the wellbore 102 via a mast, a derrick, a crane, and/or other support structure 142. The surface equipment 130 may further comprise a reel or drum 146 configured to store thereon a wound length of the conveyance line 120, which may be selectively wound and unwound by the conveyance device 140 to selectively convey the tool string 110 into, along, and out of the wellbore 102.

Instead of or in addition to the conveyance device 140, the surface equipment 130 may comprise a winch conveyance device 144 comprising or operably connected with the drum 146. The drum 146 may be rotated by a rotary actuator 148 (e.g., an electric motor) to selectively unwind and wind the conveyance line 120 to apply an adjustable tensile force to the tool string 110 to selectively convey the tool string 110 into, along, and out of the wellbore 102.

The conveyance line 120 may comprise one or more metal support wires or cables configured to support the weight of the downhole tool string 110. The conveyance line 120 may also comprise one or more insulated electrical and/or optical conductors 122 operable to transmit electrical energy (i.e., electrical power) and electrical and/or optical signals (e.g., downlink control data and/or uplink sensor data) between the tool string 110 and one or more components of the surface equipment 130, such as a power and control system 150. The conveyance line 120 may comprise and/or be operable in conjunction with means for communication between the tool string 110, the conveyance device 140, the winch conveyance device 144, and/or one or more other portions of the surface equipment 130, including the power and control system 150.

The wellbore 102 may be capped by a plurality (e.g., a stack) of fluid control devices 132, which may include a Christmas tree comprising fluid control valves, spools, and fittings individually and/or collectively operable to direct and control the flow of fluid out of the wellbore 102. The fluid control devices 132 may also or instead comprise a blowout preventer (BOP) stack operable to prevent the flow of fluid out of the wellbore 102. The fluid control devices 132 may be mounted on top of a wellhead 134.

The surface equipment 140 may further comprise a sealing and alignment assembly 136 mounted on the fluid control devices 132 and operable to seal the conveyance line 120 during deployment, conveyance, intervention, and other wellsite operations. The sealing and alignment assembly 136 may comprise a lock chamber (e.g., a lubricator, an airlock, a riser, etc.) mounted on the fluid control devices 132 and a stuffing box operable to seal around the conveyance line 120 at top of the lock chamber, although such details are not shown in FIG. 1. The stuffing box may be operable to seal around an outer surface of the conveyance line 120, for example via annular packings applied around the surface of the conveyance line 120 and/or by injecting a fluid between the outer surfaces of the conveyance line 120 and an inner wall of the stuffing box. The tool string 110 may be deployed into or retrieved from the wellbore 102 via the conveyance device 140 and/or winch conveyance device 144 through the wellhead 134, the control devices 132, and/or the sealing and alignment assembly 136.

The power and control system 150 (e.g., a control center) may be utilized to monitor and control various portions of the wellsite system 100. The power and control system 150 may be located at the wellsite surface 104 or on a structure located at the wellsite surface 104. However, the power and control system 150 may instead be located remote from the wellsite surface 104. The power and control system 150 may include a source of electrical power 152, a memory device 154, and a surface controller 156. The electrical power source 152 (e.g., a battery, an electrical generator, etc.) may supply electrical power to various equipment of the wellsite system 100, including the memory device 154, the surface controller 156, the tool string 110, the conveyance device 140, and/or the winch conveyance device 144. The surface controller 156 (e.g., a processing device, a computer, etc.) may store executable programs and/or instructions, including for implementing one or more aspects of methods, processes, and operations described herein. The surface controller 156 may be communicatively connected with various equipment of the wellsite system 100, such as may permit the surface controller 156 to monitor operations of one or more portions of the wellsite system 100 and/or to provide automatic control of one or more portions of the wellsite system 100, including the tool string 110, the conveyance device 140, and/or the winch conveyance device 144. The surface controller 156 may also or instead be used by wellsite personnel (i.e., a human operator) to manually control one or more portions of the wellsite system 100, including the tool string 110, the conveyance device 140, and/or the winch conveyance device 144. The surface controller 156 may include input devices for receiving commands from the wellsite personnel and output devices for displaying information to the wellsite personnel.

The tool string 110 may be conveyed within the wellbore 102 to perform various downhole sampling, testing, intervention, and other downhole operations. The tool string 110 may further comprise one or more downhole tools 112 (e.g., devices, modules, subs, etc.) operable to perform such downhole operations. The downhole tools 112 of the tool string 110 may include one or more of an acoustic tool, a cable head, a casing collar locator (CCL), a cutting tool, a density tool, a depth correlation tool, a directional tool, an electrical power module, an electromagnetic (EM) tool, a formation testing tool, a fluid sampling tool, a gamma ray (GR) tool, a gravity tool, a formation logging tool, a hydraulic power module, a magnetic resonance tool, a formation measurement tool, a jarring tool, a mechanical interface tool, a monitoring tool, a neutron tool, a nuclear tool, a perforating tool, a photoelectric factor tool, a plug, a plug setting tool, a porosity tool, a power module, a ram, a reservoir characterization tool, a resistivity tool, a seismic tool, a stroker tool, a surveying tool, and/or a telemetry tool, among other examples also within the scope of the present disclosure.

A plurality of wheel assemblies 114 may be connected to the tool string 110 to reduce friction between the tool string 110 and a sidewall (e.g., an internal surface) of the wellbore 102, and thus facilitate or help with conveyance of the tool string 110 along the wellbore 102. As described herein, the sidewall of the wellbore 102 may include a sidewall of the rock formation 106 if the wellbore 102 is an open-hole wellbore, a sidewall of the casing 108 along locations at which the casing 108 is installed in the rock formation 106, or a sidewall of a fluid conduit if such fluid conduit is installed within an open-hole wellbore or the casing 108. The wheel assemblies 114 may be or form a portion of the tool string 110.

Each wheel assembly 114 may comprise an axle (not shown) and a wheel rotatably connected with the axle. The axle of each wheel assembly 114 may be detachably connected to a corresponding downhole tool 112 to detachably connect the wheel assembly 114 to the tool string 110. Each wheel assembly 114 may be detachably connected with a body (e.g., a housing, a frame, a block, etc.) of a corresponding downhole tool 112 of the tool string 110. The wheel assemblies 114 may be connected to the tool string 110 when the wheel assemblies 114 are needed to help convey the tool string 110 along the wellbore 102, and disconnected from the tool string 110 when the wheel assemblies 114 are not needed to help convey the tool string 110 along the wellbore 102. The wheel assemblies 114 may be detachably connected on opposing sides of the tool string 110. The wheel assemblies 114 may be connected to the tool string 110 at various axial (i.e., longitudinal) locations along the tool string 110, such as at an upper (i.e., uphole) end of the tool string 110, at a lower (i.e., downhole) end of the tool string 110, and/or at intermediate positions along the tool string 110. Although the tool string 110 is shown comprising wheel assemblies 114 at three locations along the tool string 110, it is to be understood that the wheel assemblies 114 may be detachably connected to the tool string 110 at a lesser or greater number of locations.

Figure 2:
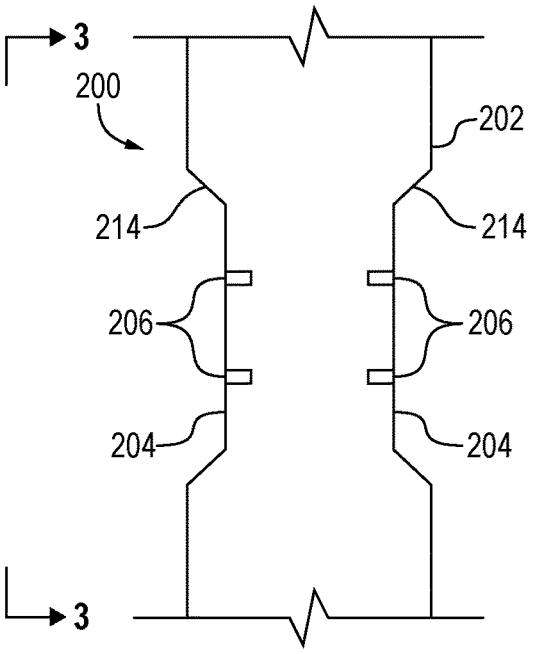
FIG. 2 is a sectional view of at least a portion of an example implementation of apparatus according to one or more aspects of the present disclosure.
Figure 3:
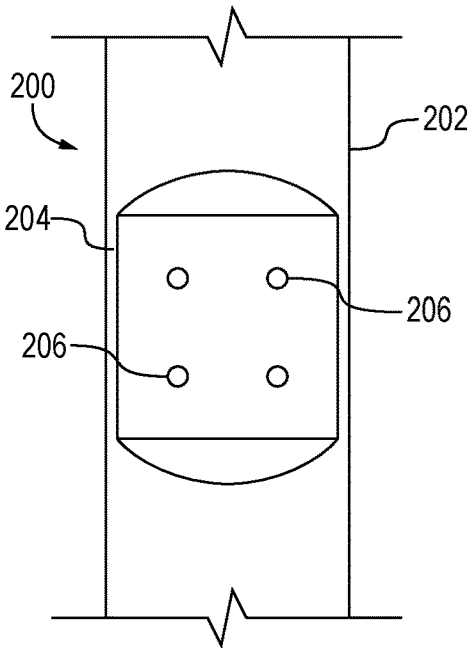
FIG. 3 is a side view of the apparatus shown in FIG. 2 according to one or more aspects of the present disclosure.

FIG. 2 is a sectional view of an example implementation of a body 202 (e.g., a housing, a frame, a block, etc.) of a downhole tool of a tool string 200 according to one or more aspects of the present disclosure. FIG. 3 is a side view of the body 202 shown in FIG. 2 according to one or more aspects of the present disclosure. The tool string 200 may comprise one or more features and/or modes of operation of the tool string 110 described above and shown in FIG. 1. The body 202 may be, comprise, or form at least a portion of a downhole tool 112 or another portion of the tool string 110. Accordingly, the following description refers to FIGS. 1-3, collectively.

A sidewall (i.e., outer surface) of the body 202 may comprise a mounting surface 204 configured to accommodate or otherwise facilitate detachable connection of a wheel assembly with the body 202. The surface 204 may be recessed, extending inwardly into the body 202. The sidewall of the body 202 may thus comprise a transition shoulder 214 between the recessed mounting surface 204 and a larger diameter portion of the body 202. The surface 204 may be substantially planar (i.e., flat) and/or comprise a substantially rectangular geometry. The body 202 may comprise one or more cavities 206 (e.g., openings, bores) extending partially into the sidewall of the body 202. For example, the cavities 206 may extend into or below the surface 204 of the body 202. Each cavity 206 may be configured to accommodate or otherwise facilitate detachable connection with a corresponding fastener of the wheel assembly. Each cavity 206 may be or comprise a threaded bore (i.e., threaded mounting bore) configured to threadedly engage with or otherwise receive a threaded fastener of the wheel assembly. The sidewall of the body 202 may further comprise additional one or more mounting surfaces 204 on the same and/or opposing side of the body 202. Each additional surface 204 may be configured to accommodate or otherwise facilitate detachable connection of a corresponding additional wheel assembly with the body 202. Opposing surfaces 204 may be or extend parallel with respect to each other. The body 202 may further comprise additional one or more cavities 206 extending partially into the sidewall of the body 202. For example, each additional cavity 206 may extend into or below the surface 204 of the body 202. Each additional cavity 206 may be configured to accommodate or otherwise facilitate detachable connection with a corresponding fastener of an additional wheel assembly. For example, each additional cavity 206 may be or comprise a threaded bore configured to threadedly engage with or otherwise receive a threaded fastener of an additional wheel assembly. Although the cavities 206 are shown extending into the body 202 along the mounting surfaces 204, the body 202 may not have mounting surfaces 204 that are recessed, and the cavities 206 may extend into a rounded portion of the sidewall of the body 202.

Figure 4:
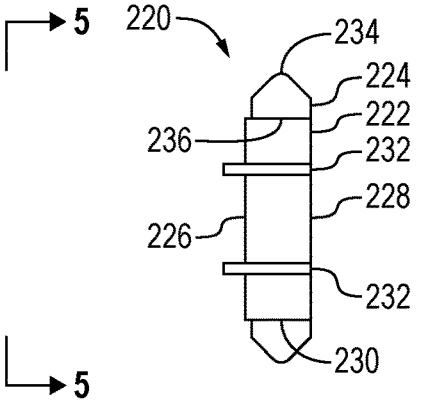
FIG. 4 is a sectional view of at least a portion of an example implementation of apparatus according to one or more aspects of the present disclosure.
Figure 5:
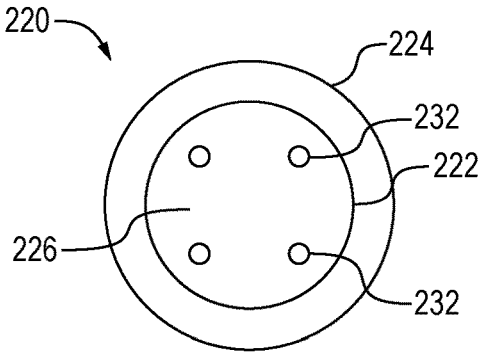
FIG. 5 is an axial view of the apparatus shown in FIG. 4 according to one or more aspects of the present disclosure.

FIG. 4 is a sectional view of an example implementation of a wheel assembly 220 according to one or more aspects of the present disclosure. FIG. 5 is a side view of the wheel assembly 220 shown in FIG. 4. The wheel assembly 220 may comprise one or more features and/or modes of operation of the wheel assemblies 114 described above and shown in FIG. 1. The wheel assembly 220 may be detachably connectable with the body 202 of the tool string 200 shown in FIGS. 2 and 3. Accordingly, the following description refers to FIGS. 1-5, collectively.

The wheel assembly 220 may be operable to reduce friction between the tool string 200 and a sidewall (i.e., inner surface) of the wellbore 102 to facilitate downhole conveyance of the tool string 200. The wheel assembly 220 may comprise an axle 222 configured to be detachably connected to the body 202 of the tool string 200 and a wheel 224 rotatably connected with the axle 222. At least a portion of the axle 222 may have a cylindrical geometry, comprising opposing outer surfaces 226, 228 (e.g., faces, planar surfaces, etc.) and an outer circumferential surface 230 extending between the outer surfaces 226, 228. The wheel assembly 220 may further comprise one or more fasteners 232 configured to engage (e.g., connect with, latch against, etc.) the axle 222 and extend from the axle 222. Each fastener 232 may be configured to extend at least partially through the axle 222 and at least partially into the sidewall of the body 202 to detachably connect the axle 222, and thus the wheel assembly 220, to the body 202. The axle 222 may comprise a plurality of bores, each extending between the outer surfaces 226, 228 and each configured to accommodate or receive a corresponding fastener 232. The axle 222 may comprise a shoulder (not shown) along each bore configured to engage (i.e., contact) a corresponding fastener 232. Each fastener 232 may comprise a head or another feature (not shown) having a shoulder (not shown) configured to engage (i.e., contact, latch against, etc.) a corresponding shoulder along the bore of the axle 222. Each fastener 232 may further comprise a shank configured to extend out of a corresponding bore of the axle 222 and into a corresponding cavity 206 of the body 202 to engage the body 202, and thus connect the axle 222 to the body 202. The shank of each fastener 232 and each cavity 206 may be threaded (not shown), facilitating threaded engagement between each fastener 232 and a corresponding cavity 206, to thereby detachably connect the axle 222 to the body 202 of the tool string 200. Although the wheel assembly 220 is shown comprising four fasteners 232 arranged in a square pattern, it is to be understood that the wheel assembly 220 may comprise one, two, three, five, six, or more fasteners 232 arranged in other patterns. Although the outer surfaces 204, 226 are shown as being substantially flat or planar, the outer surface 204 may be curved (e.g., round, convex, etc.) and the outer surface 226 may be curved (e.g., round, concave, etc.) in a complementary manner to the outer surface 204.

The wheel 224 may extend around at least a portion of the axle 222. The wheel 224 may comprise an outer circumferential portion 234 (e.g., an end, a rim, an edge, etc.) configured to contact the sidewall of the wellbore 102, and thus facilitate rolling of the wheel 224 along the sidewall of the wellbore 102. The wheel 224 may further comprise an inner circumferential surface 236 configured to contact or accommodate the outer surface 230 of the axle 222. The inner circumferential surface 236 may also or instead be configured to contact a bearing (not shown) disposed between the inner circumferential surface 236 and the outer circumferential surface 230 to reduce friction between the wheel 224 and the axle 222.

Figure 6:
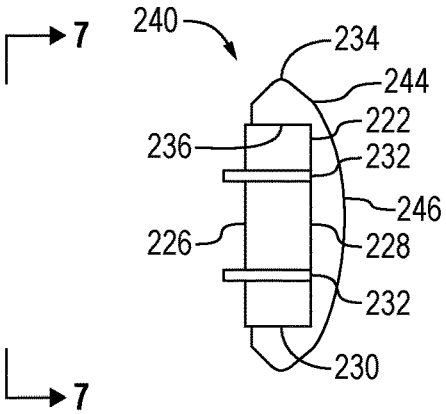
FIG. 6 is a sectional view of at least a portion of an example implementation of apparatus according to one or more aspects of the present disclosure.
Figure 7:
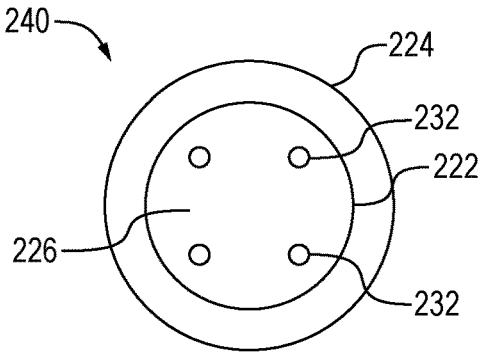
FIG. 7 is an axial view of the apparatus shown in FIG. 6 according to one or more aspects of the present disclosure.

FIG. 6 is a sectional view of an example implementation of a wheel assembly 240 according to one or more aspects of the present disclosure. FIG. 7 is a side view of the wheel assembly 240 shown in FIG. 6. The wheel assembly 240 may comprise one or more features and/or modes of operation of the wheel assembly 220 described above and shown in FIGS. 4 and 5, including where indicated by the same reference numerals. The wheel assembly 240 may be detachably connectable with the body 202 of the tool string 200 shown in FIGS. 2 and 3. Accordingly, the following description refers to FIGS. 1-7, collectively.

The wheel assembly 240 may be operable to reduce friction between the tool string 200 and a sidewall of the wellbore 102 to help or facilitate downhole conveyance of the tool string 200. The wheel assembly 240 may comprise an axle 222 configured to be detachably connected to the body 202 of the tool string 200 and a wheel 244 rotatably connected with the axle 222. The wheel assembly 240 may further comprise one or more fasteners 232 configured to engage (e.g., connect with, latch against, etc.) the axle 222 and extend from the axle 222. Each fastener 232 may be configured to extend at least partially through the axle 222 and at least partially into a sidewall of the body 202 to detachably connect the axle 222, and thus the wheel assembly 240, to the body 202. The wheel 244 may extend around at least a portion of the axle 222. The wheel 244 may comprise an outer circumferential portion 234 (e.g., an end, a rim, an edge, etc.) configured to contact a surface of the wellbore 102, and thus facilitate rolling of the wheel 244 along the surface of the wellbore 102. The wheel 244 may further comprise an inner circumferential surface 236 configured to contact or accommodate the outer surface 230 of the axle 222. The inner circumferential surface 236 may also or instead be configured to contact a bearing (not shown) disposed between the inner circumferential surface 236 and the outer circumferential surface 230 to reduce friction between the wheel 244 and the axle 222. The wheel 244 may further comprise an intermediate portion 246 (e.g., a cap, a cover, etc.) extending between the outer circumferential portion 234. The intermediate portion 246 may comprise a convex or otherwise outwardly extending outer surface configured to contact (e.g., roll over) the sidewall of the wellbore 102, such as when the tool string 200 rolls or otherwise rotates about its central longitudinal axis. The intermediate portion 246 may extend over and cover the outer surface 228 of the axle 222.

Figure 8:
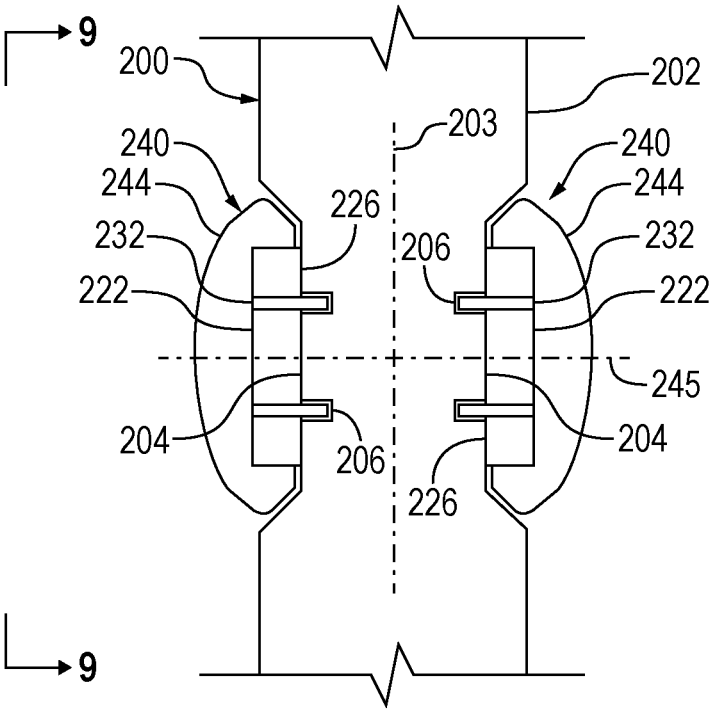
FIG. 8 is a sectional view of at least a portion of an example implementation of apparatus according to one or more aspects of the present disclosure.
Figure 9:
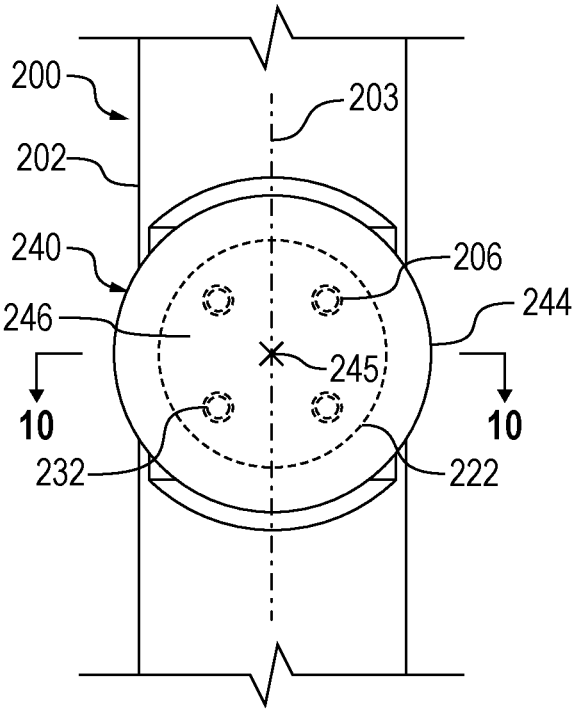
FIG. 9 is a side view of the apparatus shown in FIG. 8 according to one or more aspects of the present disclosure.
Figure 10:
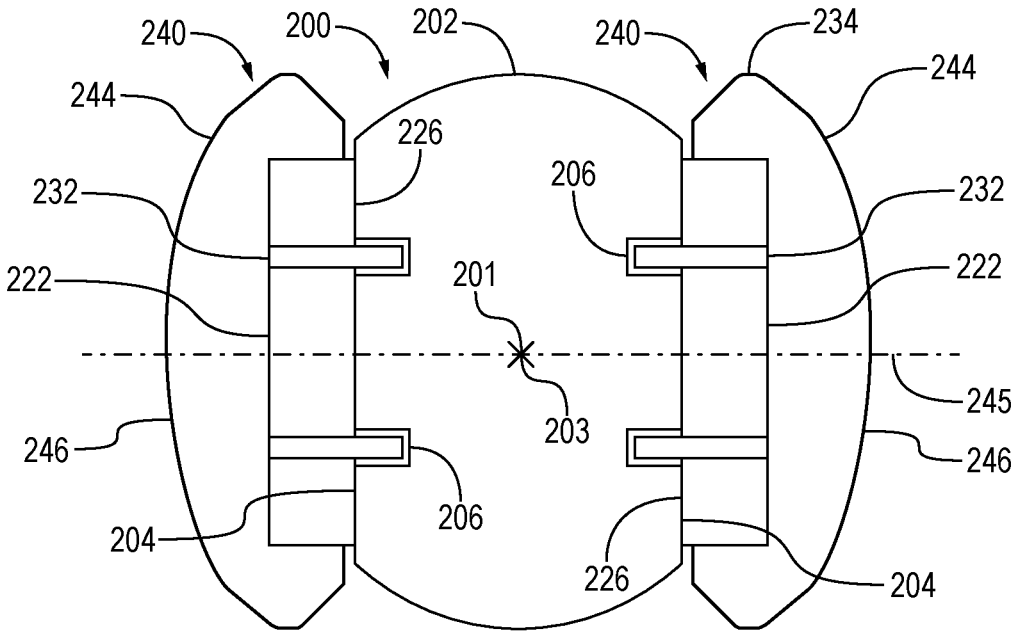
FIG. 10 is a sectional axial view of the apparatus shown in FIG. 9 according to one or more aspects of the present disclosure.

FIGS. 8, 9, and 10 are sectional side, side, and sectional axial views, respectively, of the wheel assembly 240 shown in FIGS. 6 and 7 detachably connected with the body 202 of the tool string 200 shown in FIGS. 2 and 3 according to one or more aspects of the present disclosure. Accordingly, the following description refers to FIGS. 2, 3, and 6-10, collectively.

The outer surface 226 of each wheel assembly 240 is shown disposed against (i.e., in contact with) a corresponding surface 204 of the body 202. Each fastener 232 may extend into and engage a corresponding cavity 206 of the body 202 to detachably connect the axle 222, and thus the wheel assembly 240, to the body 202 of the tool string 200. As shown in FIG. 10, the cavities 206 may be located symmetrically with respect to a central longitudinal axis 203 of the body 202 and the tool string 200, such that the wheel assemblies 240 connect symmetrically with respect to the central axis 203 and the body 202. For example, the wheel assemblies 240 may connect with the body 202 such that axes of rotation 245 of the wheels 244 extend through the central axis 203. Furthermore, the wheel assemblies 240 connected with the body 202 may collectively form or define an axial geometric profile having a geometric centerline 201, which may coincide with the central axis 203 and intercept the axes of rotation 245 when the wheel assemblies 240 are connected with the body 202. The geometric centerline 201 may be or define an axis of rotation of the body 202 and the wheel assemblies 240 connected to the body 202, such as when the tool string 200 and the wheel assemblies 240 collectively roll or otherwise rotate axially within the wellbore 102.

Figure 11:
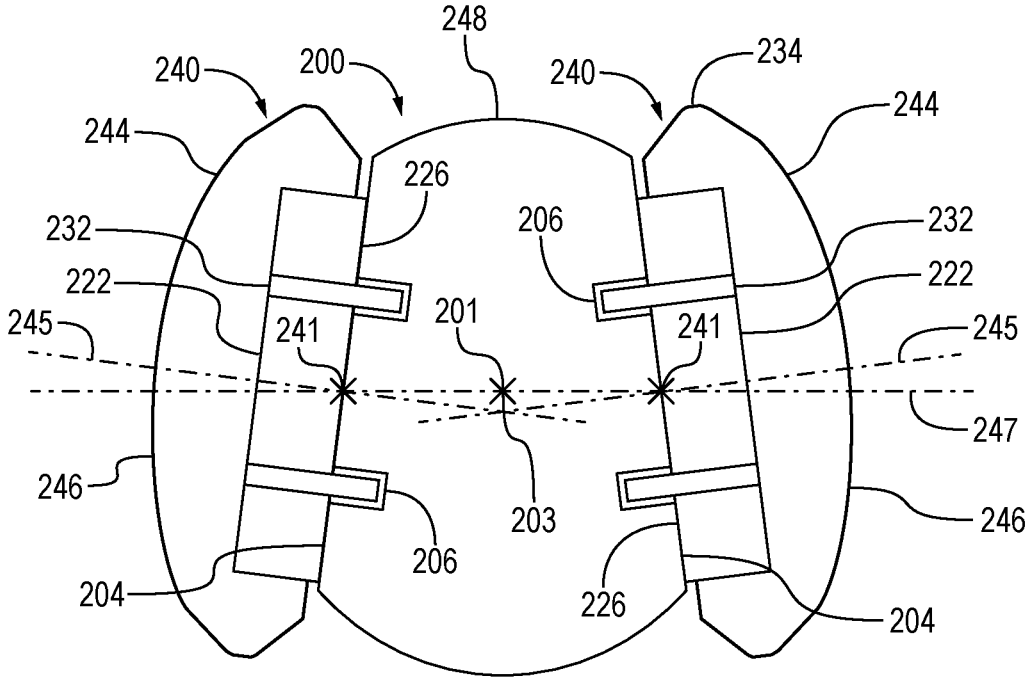
FIG. 11 is a sectional axial view of at least a portion of an example implementation of apparatus according to one or more aspects of the present disclosure.

FIG. 11 is a sectional axial view of the wheel assemblies 240 shown in FIGS. 6 and 7 detachably connected with a body 248 (e.g., a housing, a block, a frame, etc.) of the tool string 200 according to one or more aspects of the present disclosure. The body 248 may be or form at least a portion of a downhole tool 112 or another portion of the tool string 110 shown in FIG. 1. The body 248 may comprise one or more features and/or modes of operation of the body 202 of the tool string 200 described above and shown in FIGS. 2 and 3, including where indicated by the same reference numerals. Accordingly, the following description refers to FIGS. 1-3, 6, 7, and 11, collectively.

A sidewall (i.e., outer surface) of the body 248 may comprise a plurality of mounting surfaces 204 and a plurality of cavities 206, each cavity 206 extending partially into the sidewall of the body 248 below the surface 204 and configured to accommodate a corresponding fastener 232 to facilitate detachable connection of the wheel assembly 240 with the body 248. An outer surface 226 of each wheel assembly 240 is shown disposed against (i.e., in contact with) a corresponding surface 204 of the body 248. The surfaces 204 may be or extend at an angle (e.g., diagonally and/or not parallel) with respect to each other and/or the cavities 206 may be located or extend asymmetrically with respect to the central axis 203 of the body 248. Thus, the wheel assemblies 240 may connect asymmetrically with respect to the central axis 203 of the body 248, and the axes of rotation 245 of each wheel 244 may extend at an angle (e.g., diagonally, not parallel, and/or not collinear) with respect to each other. Each fastener 232 is shown extending into a corresponding cavity 206 of the body 248. Each fastener 232 may engage the body 248 to detachably connect the axle 222, and thus the wheel assembly 240, to the body 248. The wheel assemblies 240 may connect with the body 248 such that axes of rotation 245 of the wheels 244 intercept at a point below the central axis 203 or otherwise extend through the body 248 below the central axis 203 when the body 248 is oriented horizontally, as shown in FIG. 11. Although the axes of rotation 245 of the wheels 244 may extend and/or intercept below the central axis 203, the axes of rotation 245 along or on the wheels 244, as indicated by numerals 241, may be located at the same level (i.e., vertical position) as or above the central axis 203, as indicated by line 247.

Figure 12:
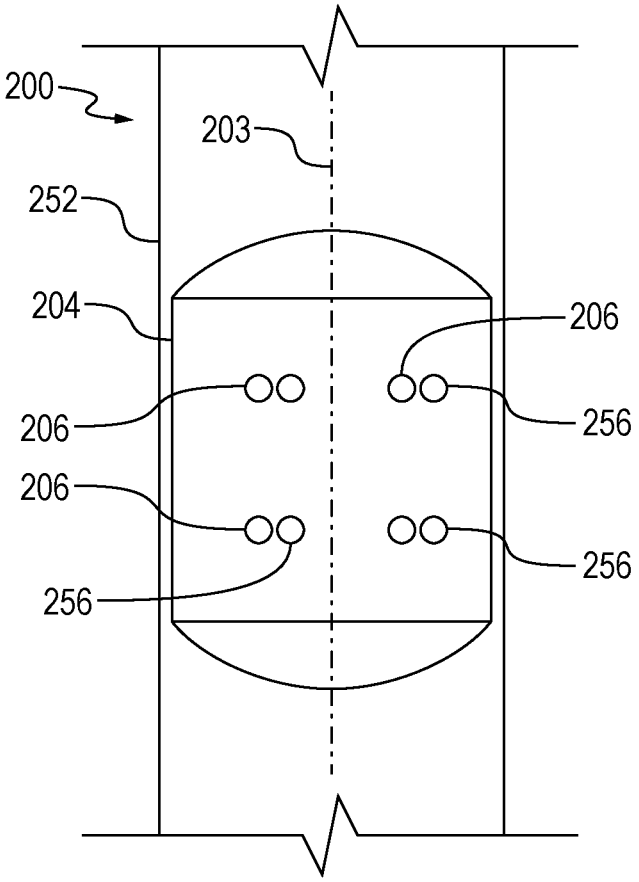
FIG. 12 is a side view of at least a portion of an example implementation of apparatus according to one or more aspects of the present disclosure.
Figure 13:
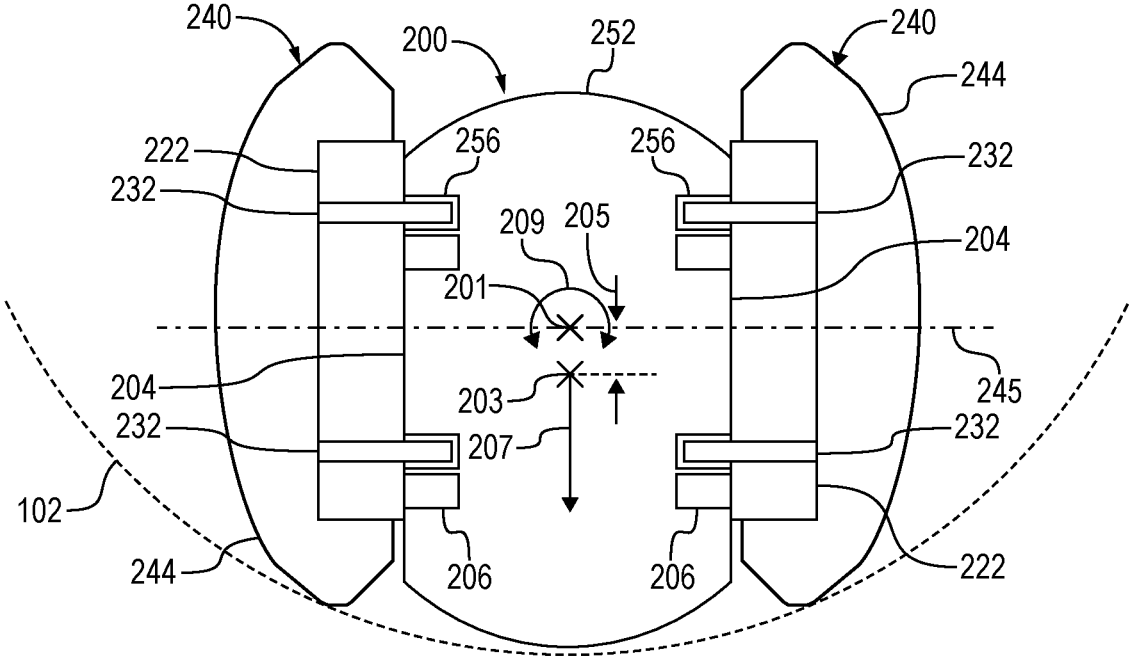
FIG. 13 is a sectional axial view of at least a portion of an example implementation of apparatus according to one or more aspects of the present disclosure.

FIG. 12 is a side view of an example implementation of a body 252 (e.g., a housing, a block, a frame, etc.) of the tool string 200 according to one or more aspects of the present disclosure. FIG. 13 is a sectional axial view of the wheel assemblies 240 shown in FIGS. 6-11 detachably connected with the body 252 according to one or more aspects of the present disclosure. The assembly of the body 252 and the wheel assemblies 240 is shown disposed within an example wellbore 102 through which the tool string 200 is conveyed. The body 252 may be or form at least a portion of a downhole tool 112 or another portion of the tool string 110 shown in FIG. 1. The body 252 may comprise one or more features of the bodies 202, 248 described above and shown in FIGS. 2, 3, and 8-11. Accordingly, the following description refers to FIGS. 1-3 and 6-13, collectively.

A sidewall (i.e., outer surface) of the body 252 may comprise a plurality of mounting surfaces 204 and a plurality of cavities 206, each cavity 206 extending partially into the sidewall of the body 252 below the surface 204 and configured to accommodate a corresponding fastener 232 to facilitate detachable connection of the wheel assembly 240 with the body 252. The cavities 206 may be located symmetrically with respect to (e.g., on each side of) the body 252 and/or the central axis 203 of the body 252 and the tool string 200, such that the wheel assemblies 240 connect symmetrically with respect to the body 252 and/or the central axis 203. For example, the wheel assemblies 240 may connect with the body 252 such that the axes of rotation 245 of the wheels 244 extend through or are at the same level (i.e., vertical position) as the central axis 203.

The sidewall of the body 252 may further comprise one or more cavities 256 (e.g., openings, holes, bores, etc.) extending partially into the sidewall of the body 252 below each surface 204 instead of or in addition to the cavities 206. Each cavity 256 may be configured to accommodate or otherwise facilitate detachable connection with a corresponding fastener 232 of the wheel assembly 240. For example, each cavity 256 may be a threaded bore configured to threadedly engage with or otherwise receive a threaded fastener 232 of the wheel assembly 240. The cavities 256 may be geometrically arranged (e.g., spaced) to align with corresponding fasteners 232 of the wheel assembly 240. The cavities 256 may be located asymmetrically (e.g., eccentrically, offset from, etc.) with respect to the body 252 and/or the central axis 203, such that each wheel assembly 240 connects asymmetrically with respect to the body 252 and/or the central axis 203. Thus, when the wheel assemblies 240 are detachably connected with the body 252 via the fasteners 232 engaging the cavities 256, the axes of rotation 245 of the wheels 244 may be located above and thus offset from the central axis 203 of the body 252 and the tool string 200 by an offset distance 205.

The wheel assemblies 240 connected with the body 252 may collectively form or define an axial geometric profile having a geometric centerline 201. The geometric centerline 201 may be an axis of rotation of the body 252 and the wheel assemblies 240 connected to the body 252, such as when the tool string 200 and the wheel assemblies 240 collectively roll or otherwise rotate axially within the wellbore 102. Because each wheel assembly 240 connects asymmetrically with respect to the body 252 and/or the central axis 203, the geometric centerline 201 may be offset from the central axis 203 by the offset distance 205. Accordingly, the center of mass of the body 252 (and the tool string 200) coinciding approximately with the central axis 203, may be located below the axes of rotation 245 of the wheels 244 and/or below the geometric centerline 201, and thus offset from the axes of rotation 245 and/or the geometric centerline 201 by the offset distance 205, when the body 252 is oriented horizontally as shown in FIG. 13.

Figure 14:
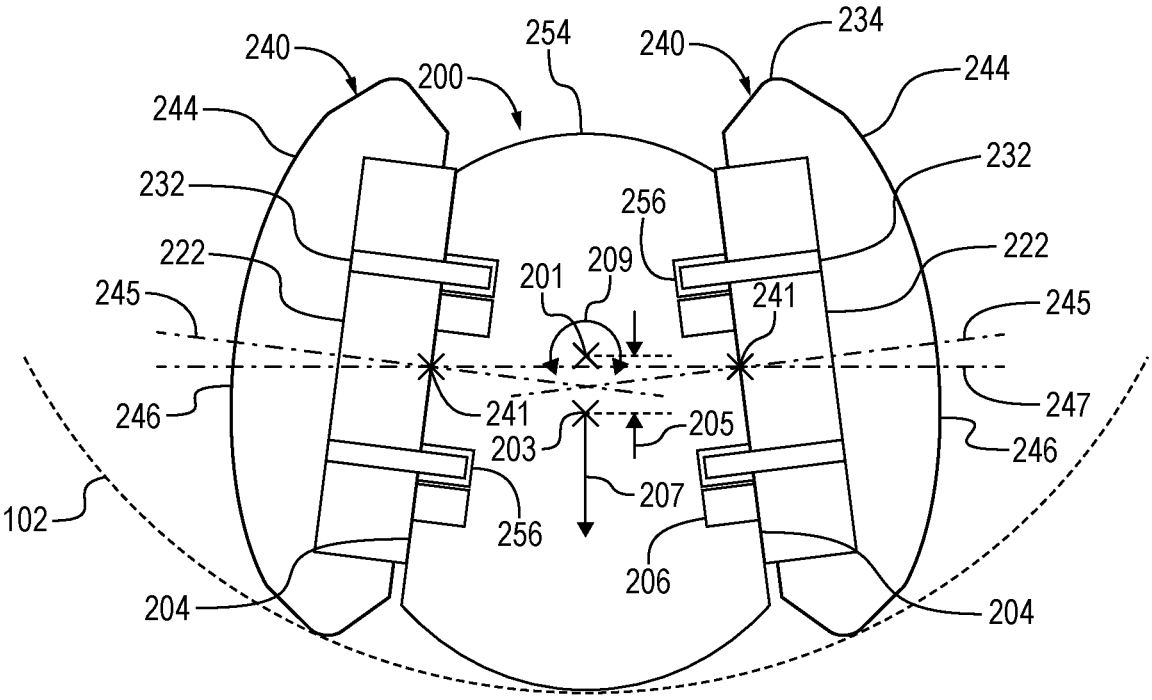
FIG. 14 is a sectional axial view of at least a portion of an example implementation of apparatus according to one or more aspects of the present disclosure.

FIG. 14 is a sectional axial view of the wheel assemblies 240 shown in FIGS. 6 and 7 detachably connected with a body 254 (e.g., a housing, a block, a frame, etc.) of the tool string 200 according to one or more aspects of the present disclosure. The assembly of the body 254 and the wheel assemblies 240 is shown disposed within an example wellbore 102 through which the assembly of the body 254 and the wheel assemblies 240 is conveyed. The body 254 may be or form at least a portion of a downhole tool 112 or another portion of the tool string 110 shown in FIG. 1. The body 254 may comprise one or more features and/or modes of operation of the bodies 202, 248, 252 of the tool string 200 described above and shown in FIGS. 2, 3, and 11-13, including where indicated by the same reference numerals. Accordingly, the following description refers to FIGS. 1-3 and 11-14, collectively.

A sidewall (i.e., outer surface) of the body 254 may comprise a plurality of mounting surfaces 204 and a plurality of cavities 206, 256, each cavity 206, 256 extending partially into the sidewall of the body 254 below the surface 204 and configured to accommodate a corresponding fastener 232 to facilitate detachable connection of the wheel assembly 240 with the body 254. The outer surface 226 of each wheel assembly 240 is shown disposed against (i.e., in contact with) a corresponding surface 204 of the body 254. The surfaces 204 may be or extend at an angle (e.g., diagonally, not parallel, etc.) with respect to each other and/or the cavities 206, 256 may be located asymmetrically with respect the central axis 203 of the body 254. Thus, the wheel assemblies 240 may connect asymmetrically with respect to central axis 203 and the body 254, and the axes of rotation 245 of each wheel 244 may extend at an angle (e.g., diagonally, not parallel, not collinear, etc.) with respect to each other. Each fastener 232 is shown extending into a corresponding cavity 256 of the body 254. Each fastener 232 may engage the body 254 to detachably connect the axle 222, and thus the wheel assembly 240, to the body 254. The wheel assemblies 240 connected with the body 254 may collectively form or define an axial geometric profile having a geometric centerline 201. The geometric centerline 201 may be an axis of rotation of the body 254 and the wheel assemblies 240 connected to the body 254, such as when the tool string 200 and the wheel assemblies 240 collectively roll or otherwise rotate axially within the wellbore 102. Connecting the wheel assemblies 240 to the body 254 via the cavities 256 offsets or shifts the geometric centerline 201 away from the central axis 203 of the body 254 by an offset distance 205. Accordingly, the center of mass of the body 254 (and the tool string 200) coinciding approximately with the central axis 203, may be located below the geometric centerline 201, and thus offset from the geometric centerline 201 by the offset distance 205, when the body 254 is oriented horizontally as shown in FIG. 14.

As shown in FIGS. 10 and 11, the geometric centerline 201 and/or the axes of rotation 245 may coincide with the central axis 203 when the wheel assemblies 240 are connected with the body 202, 248 via the cavities 206. However, as shown in FIGS. 13 and 14, the geometric centerline 201 and/or the axes of rotation 245 may be offset from (e.g., located above) the central axis 203 by an offset distance 205 when the wheel assemblies 240 are connected with a corresponding body 252, 254 via the cavities 206, 256. The weight of the bodies 252, 254 forming the tool string 200 may be much (e.g., several times) greater than the collective mass of the wheel assemblies 240 and may be represented by a downward gravitational force 207 (i.e., weight) applied at the center of mass (i.e., center of gravity) of the tool string 200, which may substantially coincide with the central axes 203 of the bodies 252, 254. Because the mass of the tool string 200 is much greater than the collective mass of the wheel assemblies 240, the offset 205 between the central axis 203 and the geometric centerline 201 and/or the axes of rotation 245 create a mechanical instability of the assembly of the tool string 200 and the wheel assemblies 240 when the center of mass of the tool string 200 and thus the central axis 203 is not located directly below the geometric centerline 201 and/or the axes of rotation 245. Such mechanical instability can result in the gravitational force 207 (i.e., weight of the tool string 200) causing a torque 209 about the geometric centerline 201 that urges rotation of the tool string 200 and wheel assemblies 240 toward a mechanically stable orientation in which the central axis 203 is located directly below the geometric centerline 201 and/or the axes of rotation 245. The torque 209 and, thus, the tendency of the tool string 200 and wheel assemblies 240 to rotate (or roll) within the wellbore 102 about the geometric centerline 201 may be directly proportional to the offset distance 205 between the central axis 203 and the geometric centerline 201 and/or the axes of rotation 245.

Accordingly, when the assembly of the tool string 200 and wheel assemblies 240 is oriented in its intended and most stable position within the wellbore 102, the central axis 203 is located directly below geometric centerline 201 at its lowermost position (i.e., closest to a lower side of the wellbore 102), as shown in FIGS. 13 and 14, and/or the axes of rotation 245 or the line 247 extend horizontally above the central axis 203, as shown in FIGS. 13 and 14. However, during downhole conveyance, when the assembly of the tool string 200 and wheel assemblies 240 is not oriented in a mechanically stable position within the wellbore 102, the gravitational force 207 applied at the central axis 203 may cause a torque 209 about the geometric centerline 201 urging rotation of the assembly of the tool string 200 and wheel assemblies 240 toward the most stable position.

Figure 15:
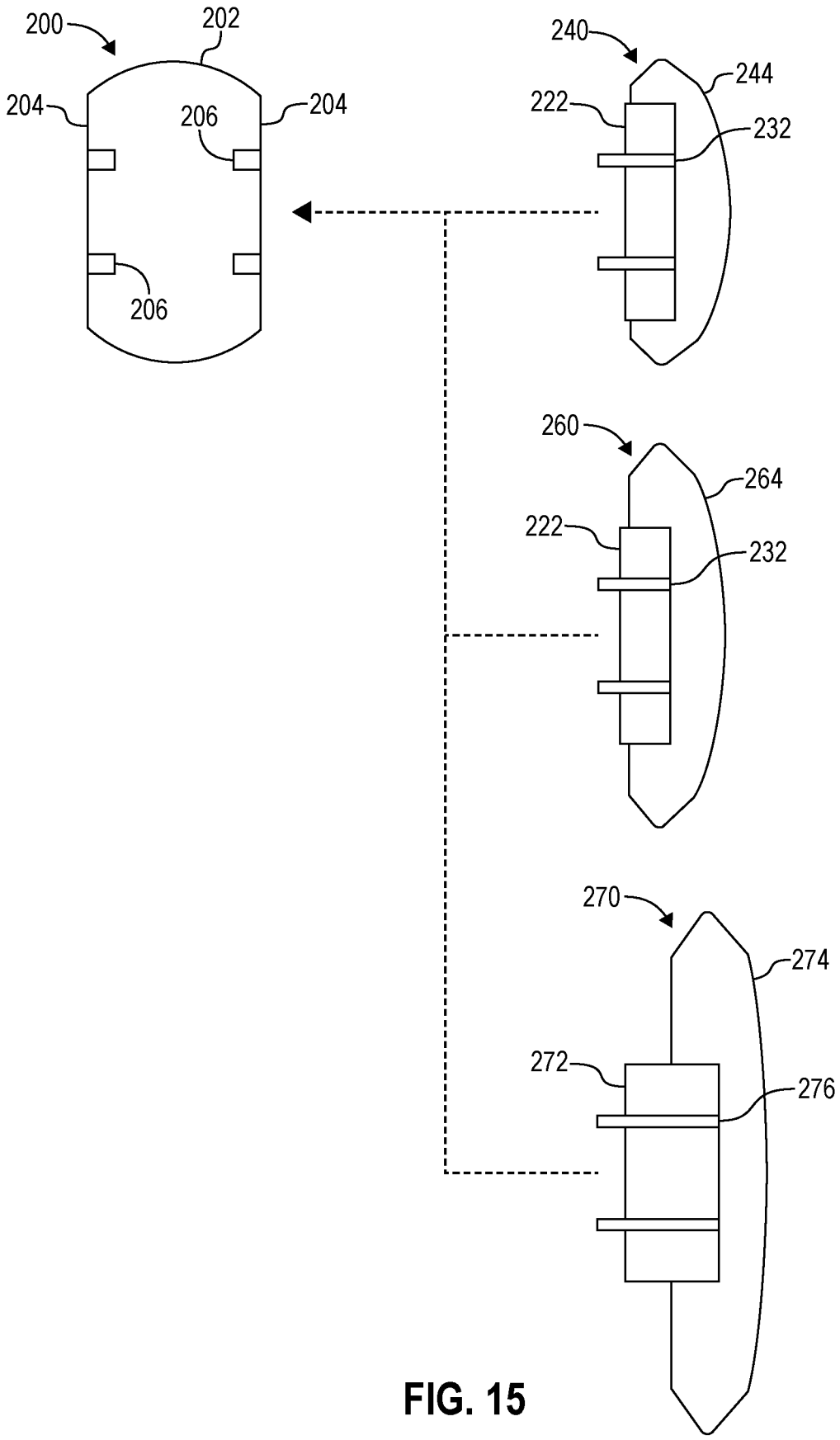
FIG. 15 is a schematic view of at least a portion of an example implementation of apparatus according to one or more aspects of the present disclosure.

The present disclosure is further directed to wheel assemblies comprising axles and wheels having different relative dimensions (e.g., diameter, length, width, etc.), which may be selected based on job type and/or wellbore specifications. FIG. 15 is a sectional axial view of a body 202 of a tool string 200 described above and shown in FIGS. 2 and 3, and a plurality of wheel assemblies 240, 260, 270, each configured to be detachably connected with the body 202. The wheel assemblies 260, 270 may each comprise one or more features of the wheel assembly 240 as described above and shown in FIGS. 6 and 7. Accordingly, the following description refers to FIGS. 2, 3, 6, 7, and 15, collectively.

The wheel assembly 240 may be detachably connected with the body 202 of the tool string 200 via fasteners 232 engaging corresponding cavities 206, as described above. The wheel assembly 260 may be similarly detachably connected with the body 202 of the tool string 200 via fasteners 232 engaging corresponding cavities 206. However, the wheel assembly 260 may comprise a wheel 264 having an outer diameter that is substantially greater than an outer diameter of the wheel 244 of the wheel assembly 240. Thus, when the body 202 is oriented horizontally, the wheel assembly 260 may increase vertical height of an assembly comprising the body 202 and the wheel assemblies 260, but not increase horizontal width of the assembly comprising the body 202 and the wheel assemblies 260. The wheel assembly 270 may be detachably connected with the body 202 of the tool string 200 via fasteners 276 extending through an axle 272 and engaging corresponding cavities 206. The axle 272 may be substantially longer than the axles 222 of the wheel assemblies 240, 260. The wheel assembly 270 may comprise a wheel 274 having an outer diameter that is substantially greater than an outer diameter of the wheel 264 of the wheel assembly 260. Thus, when the body 202 is oriented horizontally, the wheel assembly 270 may further increase vertical height of an assembly comprising the body 202 and the wheel assemblies 270, and increase horizontal width of the assembly comprising the body 202 and the wheel assemblies 270. The axle 272 may offset the wheel 274 further away from the body 202, such that the wheel 274 clears the transition shoulder 214 between the recessed mounting surface 204 and a larger diameter portion of the body 202 to prevent the wheel 274 from contacting the body 202.

Before conveying the tool string 200 downhole, wellsite personnel (e.g., a field engineer) may select a set of one of the wheel assemblies 240, 260, 270 for connection with the body 202 or another body 248, 252, 254 within the scope of the present disclosure, based on one or more factors, such as downhole operation (i.e., job) type and wellbore specifications (e.g., inclination, inner diameter, depth, etc.), among other examples. Furthermore, the wheel assemblies connected to the tool string 200 may be changed during a job or between jobs. For example, if the tool string 200 is not successfully conveyed downhole to an intended depth, the tool string 200 may be retrieved to the wellsite surface and one or more of the wheel assemblies may be disconnected and replaced with different wheel assemblies having different dimensions or other specifications. Also, if a job requires conveyance of the tool string 200 through different portions of the wellbore 102 and each portion has different specifications, the tool string 200 may be conveyed within a first portion of the wellbore 102 via a first set of wheel assemblies to perform the downhole operations. The tool string 200 may then be retrieved to the wellsite surface 104 and the wheel assemblies may be disconnected and replaced with a second set of wheel assemblies having different dimensions or other specifications. The tool string 200 may then be conveyed within a second portion of the wellbore 102 via the second set of wheel assemblies to perform the downhole operations.

Figure 16:
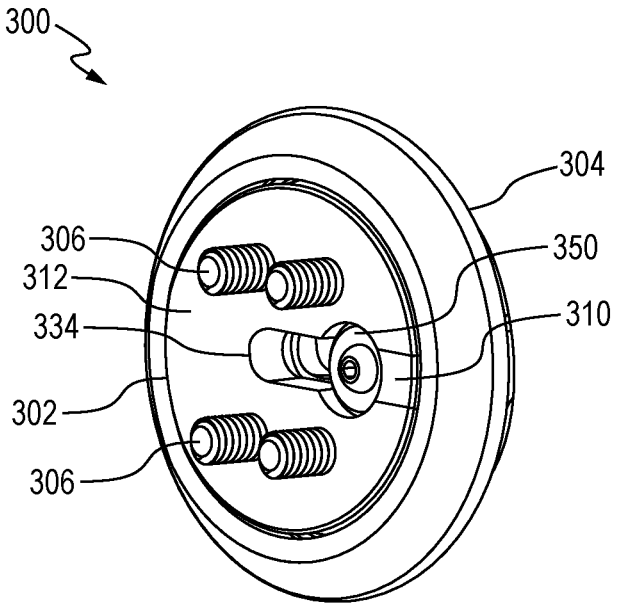
FIG. 16 is a perspective view of at least a portion of an example implementation of apparatus according to one or more aspects of the present disclosure.
Figure 17:
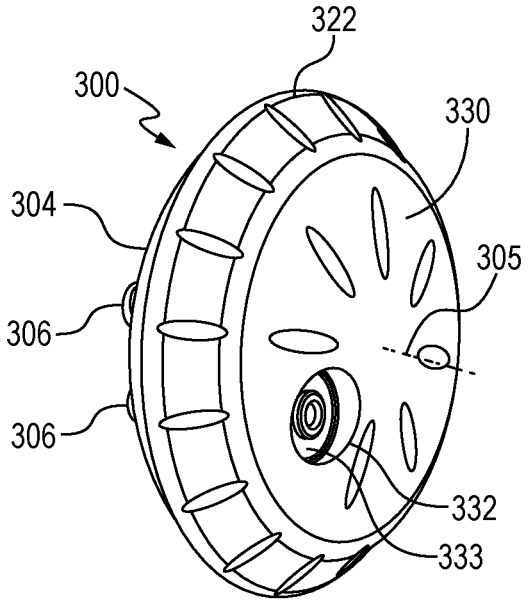
FIG. 17 is another perspective view of the apparatus shown in FIG. 16 according to one or more aspects of the present disclosure.
Figure 18:
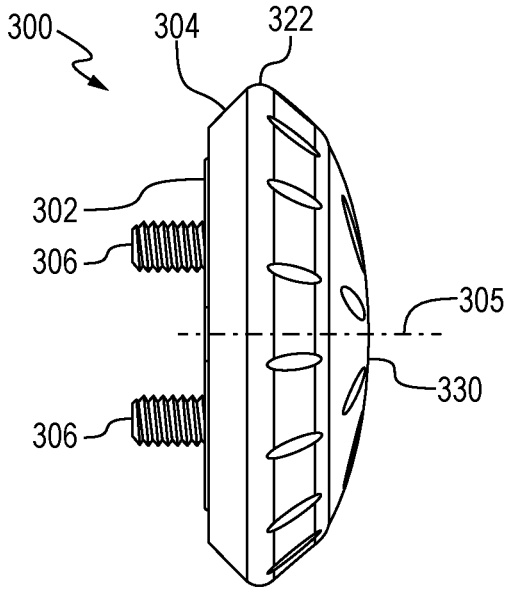
FIG. 18 is a side view of the apparatus shown in FIGS. 16 and 17 according to one or more aspects of the present disclosure.
Figure 19:
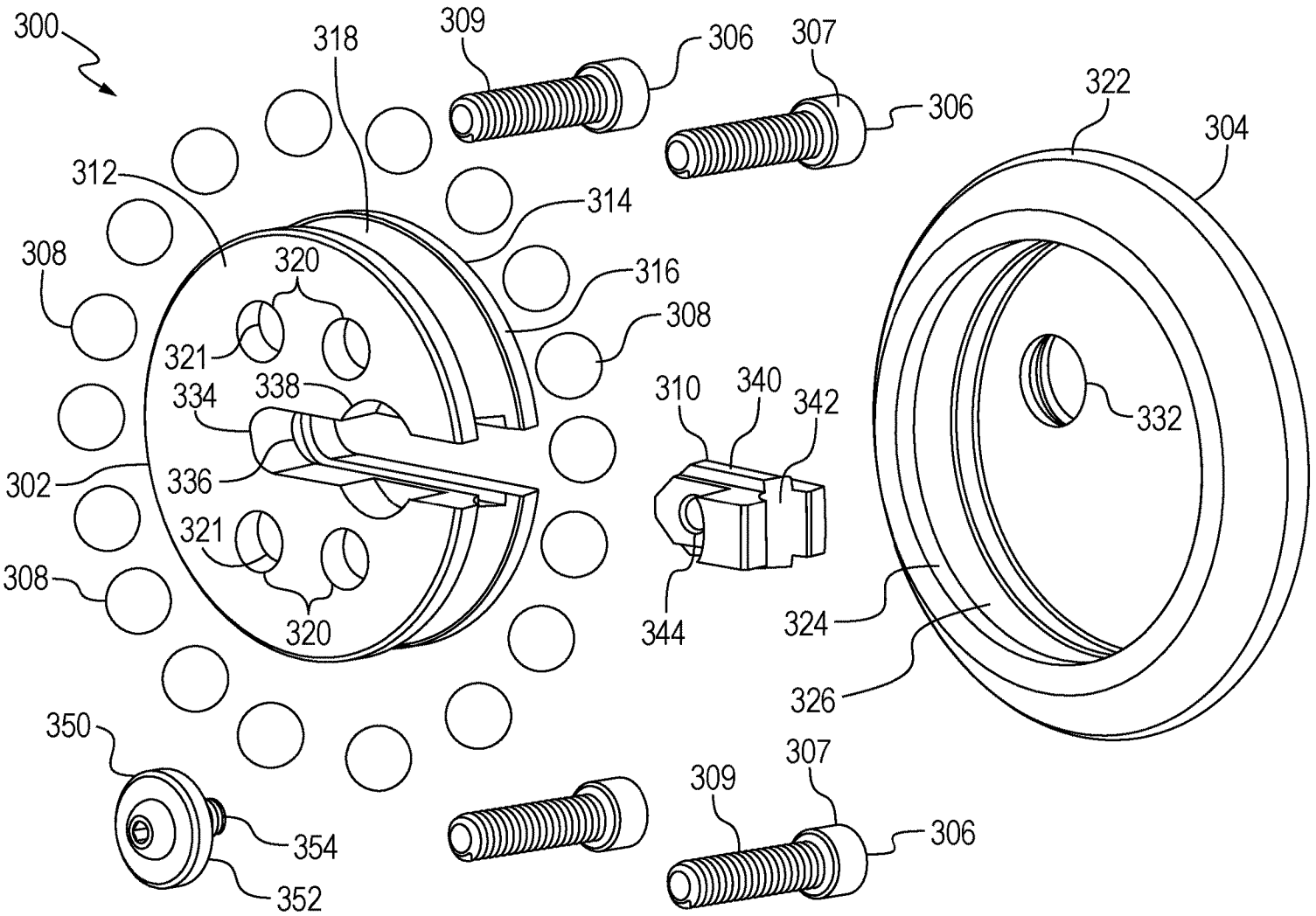
FIG. 19 is an exploded view of the apparatus shown in FIGS. 16-18 according to one or more aspects of the present disclosure.

FIG. 16 is a perspective view of an example implementation of a wheel assembly 300 according to one or more aspects of the present disclosure. FIG. 17 is a perspective view of a different side of the wheel assembly shown in FIG. 16. FIG. 18 is a side view of the wheel assembly 300 shown in FIGS. 16 and 17. FIG. 19 is an exploded view of the wheel assembly 300 shown in FIGS. 16-18. The wheel assembly 300 may comprise one or more features and/or modes of operation of the wheel assemblies 114, 240 described above and shown in FIGS. 1, 6, and 7. The wheel assembly 300 may be detachably connectable with the bodies 202, 248, 252, 254 of the tool string 200 shown in FIGS. 2, 3, and 11-14. The following description refers to FIGS. 1-3 and 16-19, collectively.

The wheel assembly 300 may be operable to reduce friction between a tool string 200 and a sidewall (i.e., inner surface) of a wellbore 102 to facilitate downhole conveyance of the tool string 200. The wheel assembly 300 may comprise an axle 302 detachably connectable to a body 202 (or another body 248, 252, 254 shown in FIGS. 11-14) of the tool string 200 and a wheel 304 rotatably connected with the axle 302. At least a portion of the axle 302 may have a cylindrical geometry, comprising opposing outer surfaces 312, 314 (e.g., faces, planes, etc.) and an outer circumferential surface 316 extending between the outer surfaces 312, 314. The outer surface 312 may be configured to abut or contact a sidewall (i.e., an outer surface) of the body 202, such as a mounting surface 204. The outer circumferential surface 316 may comprise an outer circumferential groove 318 (e.g., a channel, a track, etc.). The wheel assembly 300 may further comprise one or more fasteners 306 configured to engage (e.g., connect to, latch against, etc.) the axle 302 and extend from the axle 302. Each fastener 306 may be configured to extend at least partially through the axle 302 and at least partially into the sidewall of the body 202 to detachably connect the axle 302, and thus the wheel assembly 300, to the body. Each fastener 306 may be configured to extend into a corresponding cavity 206 (or another cavity 256 shown in FIGS. 12-14) and engage the body 202 of the tool string 200 to detachably connect the axle 302 to the body 202. The axle 302 may comprise a plurality of bores 320 (e.g., passages), each extending axially though the axle 302 between the opposing outer surfaces 312, 314 and configured to receive a corresponding fastener 306. The axle 302 may comprise a shoulder 321 (i.e., a surface transitioning between a larger diameter portion of the bore 320 and a smaller diameter portions of the bore 320) along each bore 320 configured to engage (e.g., contact, latch against, etc.) a corresponding fastener 306. Each fastener 306 may comprise a head 307 or another feature having a shoulder configured to engage (i.e., contact) a corresponding shoulder 321 along the bore 320 of the axle 302. Each fastener 306 may further comprise a shank 309 configured to extend out of a corresponding bore 320 and into a corresponding cavity 206 of the body 202 to engage the body 202, and thus connect the axle 302 to the body 202. The shank 309 of each fastener 306 and each cavity 206 may be threaded, facilitating threaded engagement between each fastener 306 and a corresponding cavity 206 to detachably connect the axle 302 to the body 202 of the tool string 200. Although the axle 302 is shown comprising four bores 320 arranged in a rectangular pattern, it is to be understood that the axle 302 may comprise one, two, three, five, six, or more bores 320 arranged in other patterns.

The wheel 304 may extend around at least a portion of the axle 302. The wheel 304 may comprise an outer circumferential portion 322 (e.g., an end, a rim, an edge) configured to contact a sidewall of the wellbore 102, and thus help or facilitate rolling of the wheel 304 along the sidewall of the wellbore 102. The wheel 304 may further comprise an inner circumferential surface 324 comprising an inner circumferential groove 326 (e.g., a channel, a track, etc.). The outer circumferential groove 318 of the axle 302 and the inner circumferential groove 326 of the wheel 304 may collectively form or otherwise define a circumferential space 328 (shown in FIG. 22) (e.g., a ring or annular shaped space or gap) between the axle 302 and the wheel 304. The wheel 244 may further comprise an intermediate portion 330 (e.g., a cap, a cover) extending between the outer circumferential portion 322. The intermediate portion 330 may comprise a convex or otherwise outwardly extending outer surface configured to contact the sidewall of the wellbore 102, such as when the tool string 200 and the wheel assemblies 300 collectively roll or otherwise rotate about a longitudinal axis (e.g., the geometric centerline 201 shown in FIGS. 10, 11, 13, and 14) of the tool string 200 within the wellbore 102. The intermediate portion 330 may cover an end of the axle 222, such as the outer surface 314 of the axle 302. The wheel 304 may comprise a bore 332 (e.g., a passage) extending through the intermediate portion 330. The bore 332 may be offset from an axis of rotation 305 of the wheel 304. The bore 332 may be aligned with each of the bores 320 and each of the fasteners 306 (if located within a corresponding bore 320), one at a time, by rotating the wheel 304 with respect to the axle 302. A fill plug 333 may be inserted into the bore 332 to permit injection and/or retention of grease or another lubricant within the space between the axle 302 and the wheel 304 to reduce friction between the axle 302 and the wheel 304.

The wheel assembly 300 may further comprise a plurality of ball bearings 308 disposed within the circumferential space 328. The ball bearings 308 may be configured to reduce friction between the axle 302 and the wheel 304. The ball bearings 308 may also connect or lock the wheel 304 to the axle 302. For example, the ball bearings 308 disposed within the circumferential space 328 may contact and bear against opposing sidewalls or shoulders of the circumferential grooves 318, 326 to latch the wheel 304 to the axle 302, thereby preventing the wheel 304 from separating from the axle 302.

The axle 302 may further comprise a passage 334 (e.g., a channel, a bore, a space, etc.) extending through or along the axle 302 between the outer surface 312 and the circumferential outer surface 316 (along the circumferential outer groove 318). The passage 334 may thus connect with or intercept the circumferential space 328. Accordingly, the passage 334 may connect the space external to the outer surface 312 and the circumferential space 328, thereby forming a pathway between the space external to the outer surface 312 and the circumferential space 328. The passage 334 may also or instead extend through or along the axle 302 between the outer surface 314 and the circumferential outer surface 316 (along the circumferential outer groove 318). Accordingly, the passage 334 may connect the space external to the outer surface 314 and the circumferential space 328, thereby forming a pathway between the space external to the outer surface 314 and the circumferential space 328. The passage 334 may extend radially through or along the axle 302, such as perpendicularly or otherwise laterally with respect to a central axis of the axle 302. The passage 334 may connect with or intercept the outer circumferential groove 318 and the circumferential space 328 at a substantially right angle. For example, the passage 334 may connect with or intercept the outer circumferential groove 318 and the circumferential space 328 at an angle ranging between about 60 degrees and about 120 degrees, at an angle ranging between about 70 degrees and about 110 degrees, at an angle ranging between about 80 degrees and about 100 degrees, or at an angle ranging between about 85 degrees and about 95 degrees. The passage 334 may connect with or intercept the outer circumferential groove 318 and the circumferential space 328 at a right angle (i.e., at an angle of 90 degrees). The passage 334 may also extend axially through the axle 302 between the opposing outer surfaces 312, 314. However, the passage 334 may extend axially into the outer surface 312 of the axle 302 without extending axially through the axle 302 between the opposing outer surfaces 312, 314. The axle 302 may further comprise a retaining feature 336 extending longitudinally along the passage 334. For example, the retaining feature 336 may be or comprise a groove (e.g., a track) extending longitudinally along the passage 334 or a protrusion (e.g., a rail, a lip, etc.) extending longitudinally along the passage 334. The axle 302 may further comprise a cavity 338 extending axially (i.e., parallel with respect to the central axis of the axle 302) into the outer surface 312 (or the outer surface 314) of the axle 302 below the outer surface 312. The cavity 338 may have a larger inner diameter than a width of the passage 334. The cavity 338 may be located along or otherwise intercept the passage 334.

Figure 23:
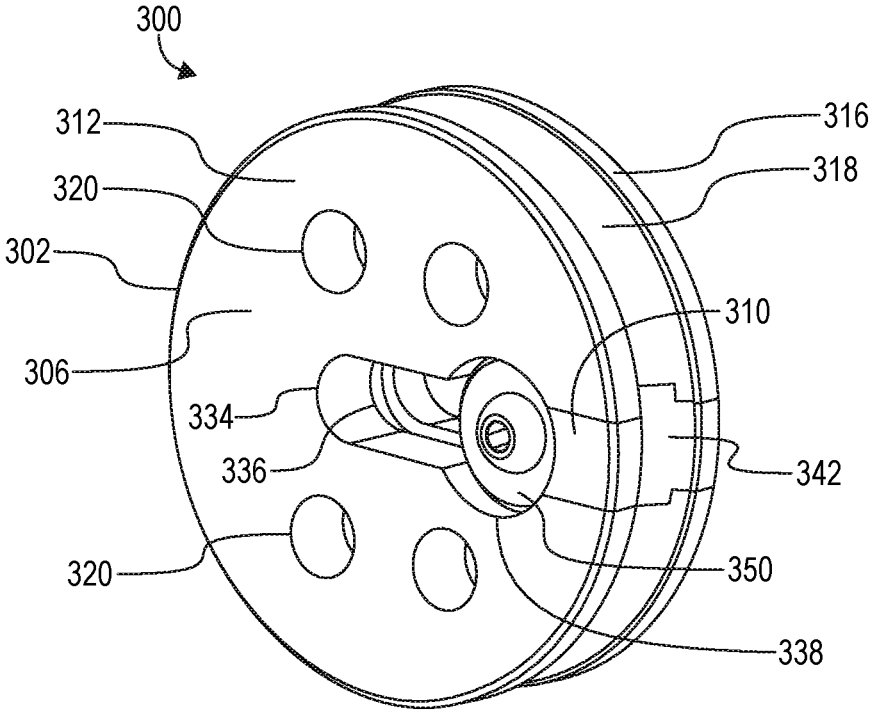
FIG. 23 is a perspective view of a portion of the apparatus shown in FIGS. 20-22 in a different stage of assembly operations.

The wheel assembly 300 may further comprise a blocking member 310 (e.g., a plug, a stopper, etc.) disposed within the passage 334. The blocking member 310 may be movable (e.g., slidable) within the passage 334 between a first position in which the ball bearings 308 can be inserted into the circumferential space 328 via the passage 334 and a second position in which the blocking member 310 prevents the ball bearings 308 from exiting the circumferential space 328 via the passage 334. The blocking member 310 may comprise a retaining feature 340 extending longitudinally along the blocking member 310 and configured to engage the retaining feature 336 of the axle 302. While engaged, the retaining features 336, 340 may permit the blocking member 310 to move (e.g., slide) along the passage 334 and to retain the blocking member 310 within the passage 334 or otherwise prevent the blocking member 310 from moving out of the passage 334. The retaining feature 340 may be or comprise a groove (e.g., a track) extending longitudinally along the blocking member 310 or a protrusion (e.g., a rail, a lip, etc.) extending longitudinally along the blocking member 310. The blocking member 310 may form a portion of the outer circumferential groove 318 of the axle 302 when the blocking member 310 is in the second position, as shown in FIG. 23. For example, the blocking member 310 may comprise a groove 342 (e.g., a track) forming a portion of the outer circumferential groove 318 of the axle 302, and thus defining a portion of the circumferential space 328, when the blocking member 310 is in its second position. The blocking member 310 may further comprise a bore 344 extending into or through the blocking member 310. The bore 344 may be or comprise a threaded bore.

Although the retaining feature 336 is shown extending the entire length of the passage 334, the retaining feature 336 may not necessarily extend the entire length of the passage 334. For example, the retaining feature 336 may extend along a radially outward portion (i.e., closer to the surface 316) of the passage 334, but not along a radially inward portion (i.e., closer to the central axis of the axle 302) of the passage 334. Such configuration may permit the blocking member 310 to be retained within the passage 334 when the blocking member 310 is in its second position and permit the blocking member 310 to be removed from the passage 334 when the blocking member 310 is in its first position.

The wheel assembly 300 may further comprise a fastener 350 configured to engage the axle 302 and the blocking member 310 to fixedly connect the blocking member 310 in its second position within the passage 334. The fastener 350 may be disposed within the cavity 338 of the axle 302 and extend into the bore 344 of the blocking member 310 to fixedly connect the blocking member 310 in its second position within the passage 334. The fastener 350 may comprise a head 352 and a shank 354. The shank 354 can be inserted into the bore 344 to engage (i.e., connect) the fastener 350 to the retaining member 310 and the head 352 can be inserted into the cavity 338 to engage (i.e., connect or latch) the fastener 350 to the axle 302. The sidewalls of the cavity 338 may bear against or otherwise contact the head 352 to prevent the fastener 350, and thus the blocking member 310, from moving along the passage 334 or otherwise with respect to the axle 302, thereby fixedly connecting the blocking member 310 in the second position within the passage 334. The shank 354 may be a threaded shank and the bore 344 may be a threaded bore. Accordingly, the fastener 350 may be fixedly connected to the blocking member 310 when the blocking member 310 is the second position within the passage 334 by threadedly engaging the shank 354 with the bore 344.

Figure 20:
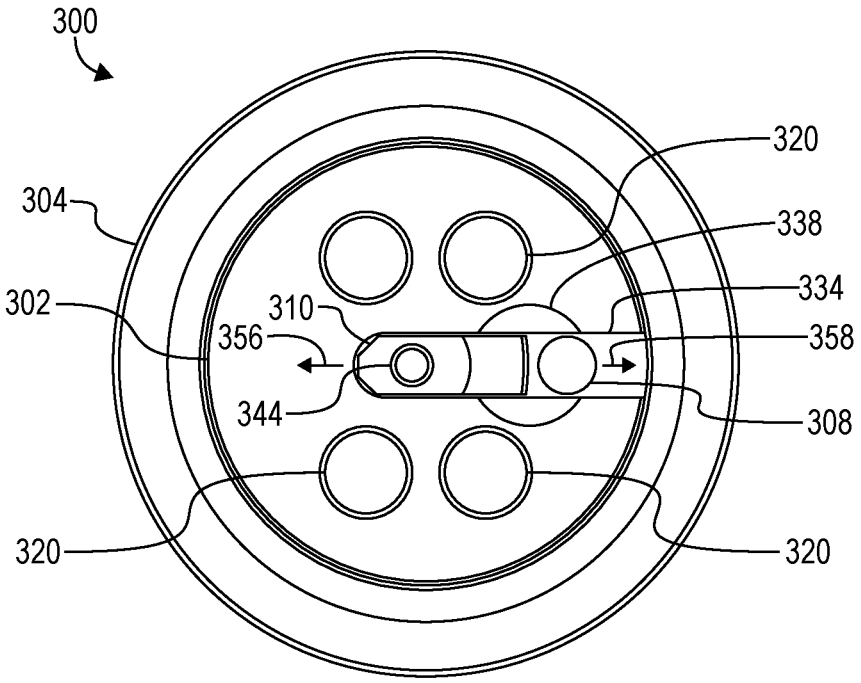
FIG. 20 is an axial view of the apparatus shown in FIGS. 16-19 in a stage of assembly operations.
Figure 21:
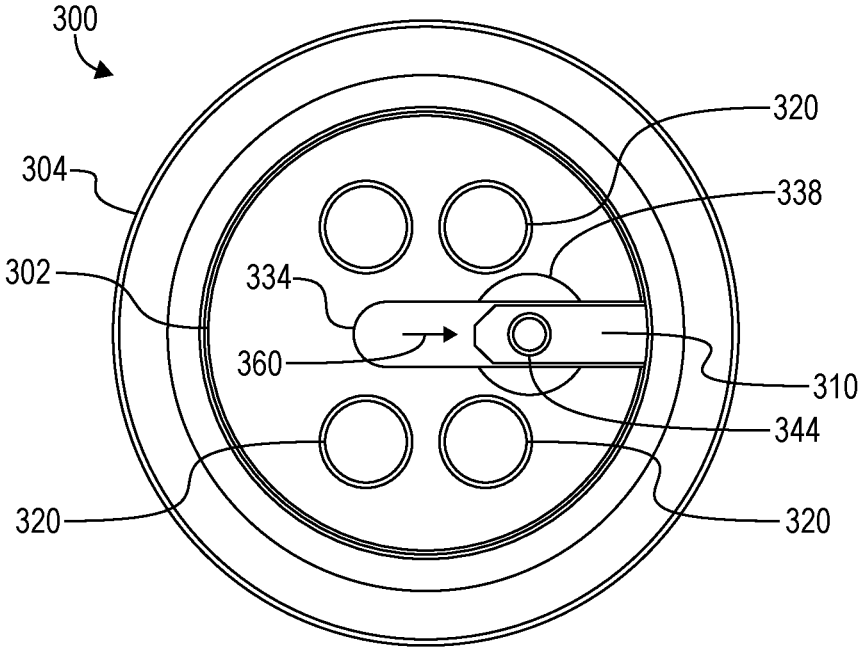
FIG. 21 is an axial view of the apparatus shown in FIG. 20 in a different stage of assembly operations.
Figure 22:
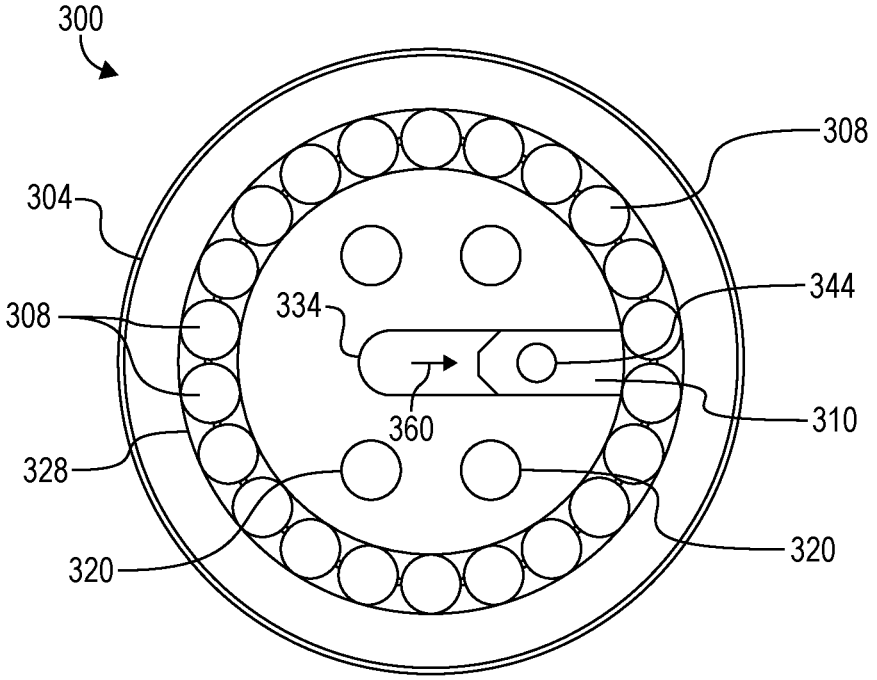
FIG. 22 is a sectional axial view of the apparatus shown in FIG. 21 according to one or more aspects of the present disclosure.

The present disclosure is further directed to methods (e.g., operations, processes) of assembling (e.g., putting together, constructing, etc.) a wheel assembly, such as the wheel assembly 300 shown in FIGS. 16-19, according to one or more aspects of the present disclosure. FIGS. 20 and 21 are side views of the wheel assembly 300 during different stages of assembly operations. FIG. 22 is a sectional view of the wheel assembly 300 shown in FIG. 21. FIG. 23 is a perspective view of the wheel assembly shown in FIGS. 20-22 in still another stage of assembly operations. Accordingly, the following description refers to FIGS. 16-23, collectively.

A method of assembling the wheel assembly 300 may comprise disposing the wheel 304 around the axle 302 to form the circumferential space 328 between the wheel 304 and the axle 302. As shown in FIG. 20, the blocking member 310 may be moved (e.g., slid) along the passage 334 in a radially inward direction with respect to the axle 302, as indicated by arrow 356, to its first position in which the blocking member 310 is located at a radially inward end of the passage 334 (i.e., at a radially inward position with respect to the axle 302), thereby opening (i.e., unblocking) the passage 334 such that the ball bearings 308 can be inserted into the circumferential space 328 via the passage 334, as indicated by arrow 358. Moving the blocking member 310 along the passage 334 may comprise sliding the blocking member 310 along the retaining feature 336 of the axle 302 while the retaining feature 336 is engaged with the retaining feature 340 of the blocking member 310 to retain the blocking member 310 within the passage 334. If the axle 302 does not comprise the retaining feature 336 at the first position of the blocking member 310, the blocking member 310 may be removed from the passage 334. When the blocking member 310 is removed from the passage 334 or is in the first position within the passage 334, the ball bearings 308 may be inserted into the passage 334 and moved into the circumferential space 328 via the passage 334, as indicated by arrow 358.

As shown in FIGS. 21 and 22, after all the ball bearings 308 are inserted into the circumferential space 328, the blocking member 310 may be moved (e.g., slid) along the passage 334 in a radially outward direction with respect to the axle 302, as indicated by arrow 360, to its second position in which the blocking member 310 is at a radially outward position with respect to the axle 302 in which the blocking member 310 is located at a radially outward end of the passage 334 to close off (i.e., block) the passage 334 from the circumferential space 328 thereby preventing the ball bearings 308 from exiting the circumferential space 328 via the passage 334. The ball bearings 308 may reduce friction between the axle 302 and the wheel 304 and prevent separation of the wheel 304 from the axle 302, thereby connecting the wheel 304 to the axle 302.

As shown in FIGS. 16 and 23, when the blocking member 310 is moved to the second position along the passage 334, the blocking member 310 may then be fixedly connected or otherwise fastened to the axle 302 with the fastener 350, such as by inserting the fastener 350 at least partially into, through, or between the axle 302 and the blocking member 310. For example, the blocking member 310 may be fastened to the axle 302 with the fastener 350 by inserting the head 352 of the fastener 350 into the cavity 338 extending into the axle 302 along the passage 334 while inserting the shank 354 of the fastener 350 into the bore 344 of the blocking member 310. If the shank 354 and bore 344 are threaded, the threaded shank 354 may be threadedly engaged with the threaded bore 344 to fixedly connect the fastener 350 with the blocking member 310. The head 352 engages (i.e., latches against or contacts) the axle (i.e., sidewalls of the cavity 338) to prevent the fastener 350 and thus the blocking member 310 from moving from it second position. Accordingly, the fastener 350 may engage both the blocking member 310 and the axle 302 when the blocking member 310 is in its second position to prevent the blocking member 310 from moving along the passage from its second position to its first position. Furthermore, the blocking member 310 may comprise a groove 342 (e.g., a track) forming a portion of the outer circumferential groove 318 of the axle 302 when the blocking member 310 is in its second position. It is noted that FIG. 23 shows the wheel assembly 300 without the wheel 304 and ball bearings 308 to more clearly show the axle 302 and the blocking member 310 while in its second position.

Figure 24:
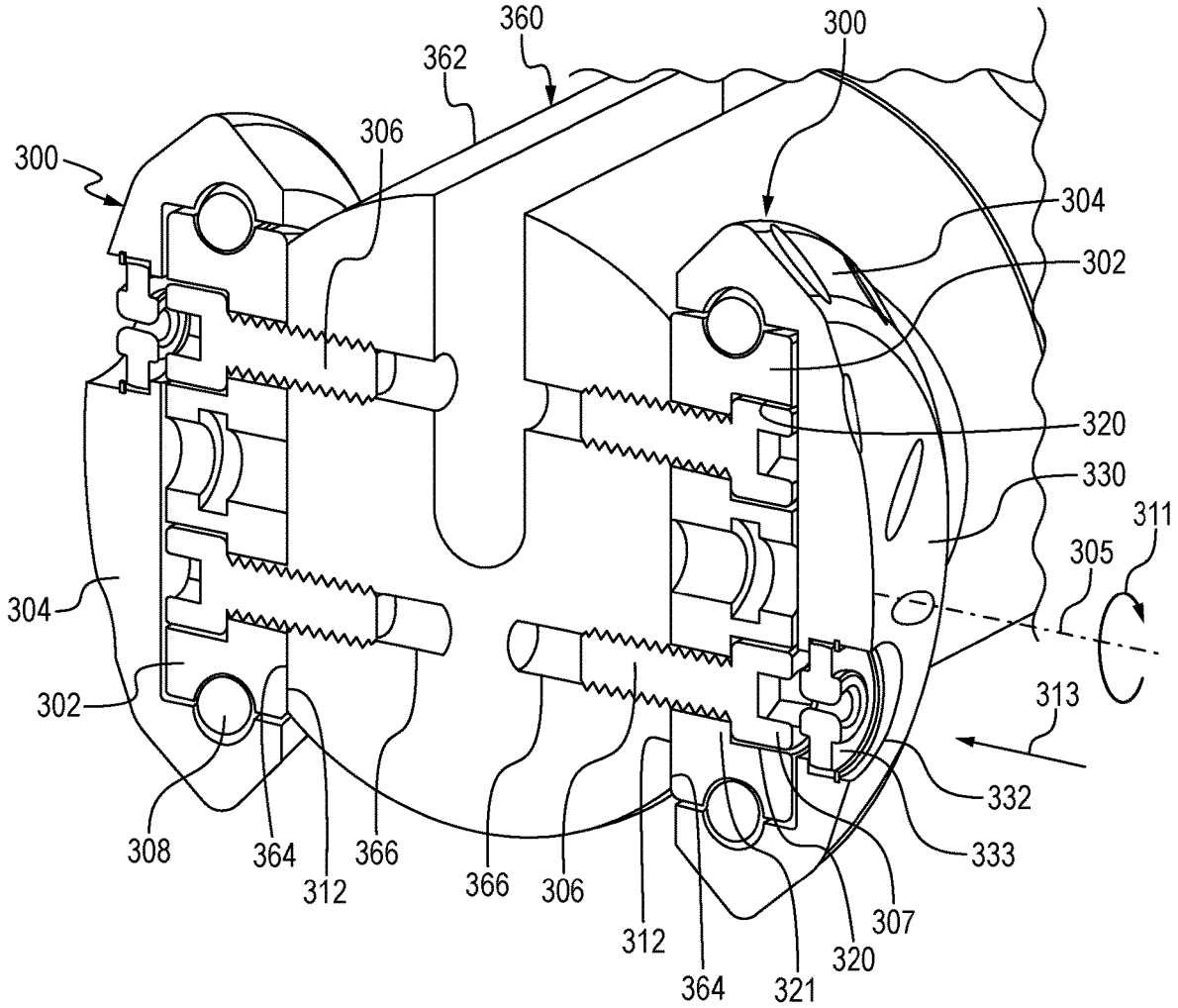
FIG. 24 is a perspective sectional view of the apparatus shown in FIGS. 16-19 in a stage of connection operations.

The present disclosure is further directed to methods (e.g., operations, processes) of detachably connecting (e.g., coupling, fastening) a wheel assembly, such as the wheel assembly 300 shown in FIGS. 16-23, to a sidewall (i.e., outer surface) of a downhole tool of a downhole tool string to reduce friction between the downhole tool and a sidewall (i.e., inner surface) of a wellbore to facilitate downhole conveyance of the downhole tool. FIG. 24 is a perspective sectional view of the wheel assembly 300 detachably connected with a body 362 of a downhole tool of a downhole tool string 360. The tool string 360 may comprise one or more features and/or modes of operation of the tool strings 110, 200 described above and shown in FIGS. 1 and 2. The body 362 may comprise one or more features of the bodies 202, 248, 252, 254 described above and shown in FIGS. 2, 3, 11, 13, and 14.

An example method may include positioning the wheel assembly 300 against a sidewall of the body 362 of the tool string 360. For example, the surface 312 of the axle 302 of the wheel assembly 300 may be disposed against or otherwise in contact with a corresponding mounting surface 364 of the body 362, such that each of the bores 320 of the axle 302 is aligned with a corresponding one of the threaded bores 366 extending into the sidewall of the body 362 along the surface 364. Thereafter, the fasteners 306 may be inserted at least partially through the axle 302 and inserted at least partially into the sidewall of the body 362 to connect the wheel assembly 300 to the body 362. For example, the wheel 304 may be rotated about the axis of rotation 305, as indicated by arrow 311, to align the bore 332 extending through the cap 330 of the wheel 304 with a selected one of the bores 320 of the axle 302. One of the fasteners 306 may then be inserted into the selected one of the bores 320 through the bore 332, as indicated by arrow 313, and positioned against the threaded bore 366 of the body 362. A torqueing tool (e.g., a hand wrench, an automated torqueing tool) (not shown) may then be inserted into the bore 320 through the bore 332 and engaged with the head 307 of the fastener 306. The torqueing tool may then be operated to rotate the fastener 306 to threadedly engage the fastener 306 within the threaded bore 366 until the shoulder of the head 307 of the fastener 306 contacts the shoulder 321 of the axle 302. The wheel 304 may be rotated further to align the bore 332 extending through the cap 330 of the wheel 304 with another one of the bores 320 of the axle 302. Another one of the fasteners 306 may then be inserted into the bore 320 through the bore 332 and threadedly engaged within the threaded bore 366. The above process may be repeated until every fastener 306 is threadedly engaged with the body 362 to connect the axle 302 to the body 362. The fill plug 333 may be inserted into the bore 332 and grease or another lubricant may then be injected into the space between the axle 302 and the wheel 304, including the circumferential space 328, to lubricate the ball bearings 308 and various surfaces of the axle 302 and the wheel 304.

In view of the entirety of the present disclosure, a person having ordinary skill in the art will readily recognize that the present disclosure introduces an apparatus comprising a wheel assembly configured to detachably connect to a downhole tool to thereby reduce friction between the downhole tool and a sidewall of a wellbore through which the downhole tool is conveyed, wherein the wheel assembly comprises: an axle configured to contact a sidewall of the downhole tool; a wheel rotatably connected with the axle; and a fastener configured to extend into the sidewall of the downhole tool to detachably connect the axle to the downhole tool.

The fastener may extend through at least a portion of the axle and out of the axle.

The fastener may be or comprise a threaded bolt.

The fastener may be or comprise a threaded fastener extending through at least a portion of the axle and out of the axle, and the fastener may be configured to threadedly engage a threaded bore extending into the sidewall of the downhole tool to detachably connect the axle to the downhole tool.

The axle may comprise a first bore extending therethrough, the fastener may be disposed within and extend out of the first bore, the wheel may comprise a second bore configured to accommodate the fastener therethrough, and rotating the wheel with respect to the axle may move the second bore into and out of alignment with the first bore. The first bore may be one of a plurality of first bores, the fastener may be one of a plurality of fasteners, and rotating the wheel with respect to the axle may move the second bore one at a time into alignment with each of the first bores. Each of the first bore and the second bore may be offset from an axis of rotation of the wheel.

The apparatus may further comprise the downhole tool, the fastener may be one of a plurality of fasteners, the downhole tool may comprise a plurality of threaded bores extending into the sidewall of the downhole tool, and each fastener may threadedly engage a corresponding threaded bore to detachably connect the axle to the downhole tool.

The wheel assembly may be one of a plurality of wheel assemblies, and when the wheel assemblies are detachably connected with the downhole tool: the wheel assemblies may collectively define an axial profile having an axis of rotation; and the axis of rotation may be offset from a central axis of the downhole tool.

The wheel assembly may be one of a plurality of wheel assemblies, each wheel may rotate about an axis of rotation, and, when the wheel assemblies are detachably connected with the downhole tool, the axes of rotation may be offset from a central axis of the downhole tool.

The apparatus may further comprise the downhole tool, the fastener may be one of a plurality of fasteners, the downhole tool may comprise a plurality of mounting bores extending into the sidewall of the downhole tool, the mounting bores may be located asymmetrically with respect to a central axis of the downhole tool, and each fastener may engage a corresponding mounting bore to detachably connect the wheel assembly to the downhole tool.

The present disclosure also introduces a method comprising connecting a wheel assembly to a downhole tool to reduce friction between the downhole tool and a sidewall of a wellbore through which the downhole tool is conveyed, wherein the wheel assembly comprises an axle and a wheel rotatably connected with the axle, and wherein connecting the wheel assembly to the downhole tool comprises inserting a fastener at least partially into a sidewall of the downhole tool to connect the axle to the downhole tool.

The fastener may be a threaded fastener and inserting the fastener at least partially into the sidewall of the downhole tool may comprise threadedly engaging the fastener within a threaded bore extending into the sidewall of the downhole tool to connect the axle to the downhole tool.

The fastener may be a threaded fastener, the downhole tool may comprise a threaded bore extending into the sidewall of the downhole tool, the axle may comprise a bore extending therethrough, the wheel may comprise a bore extending therethrough, the bore of the axle and the bore of the wheel may be offset from an axis of rotation of the wheel, and connecting the wheel assembly to the downhole tool may further comprise: disposing the axle against the sidewall of the downhole tool such that the bore of the axle is aligned with the threaded bore; rotating the wheel with respect to the axle to align the bore of the wheel with the bore of the axle; inserting the fastener into the threaded bore through the bore of the axle and the bore of the wheel; and threadedly engaging the fastener within the threaded bore to connect the axle to the downhole tool.

Connecting the wheel assembly to the downhole tool may further comprise, before inserting the fastener at least partially into the sidewall of the downhole tool, inserting the fastener at least partially through the axle.

The fastener may be a threaded fastener, the downhole tool may comprise a threaded bore extending into the sidewall of the downhole tool, the axle may comprise a bore extending therethrough, and connecting the wheel assembly to the downhole tool may further comprise: disposing the axle against the sidewall of the downhole tool such that the bore of the axle is aligned with the threaded bore; inserting the fastener into the threaded bore through the bore of the axle; and threadedly engaging the fastener within the threaded bore to connect the axle to the downhole tool.

The present disclosure also introduces an apparatus comprising a wheel assembly for a downhole tool, wherein the wheel assembly is operable to reduce friction between the downhole tool and a sidewall of a wellbore through which the downhole tool is conveyed, and wherein the wheel assembly comprises: an axle comprising an outer circumferential groove and a passage extending though the axle; a wheel disposed around the axle and comprising an inner circumferential groove, wherein the outer circumferential groove and the inner circumferential groove collectively define a circumferential space between the axle and the wheel, and wherein the passage intersects the circumferential space; a plurality of ball bearings disposed within the circumferential space and configured to reduce friction between the axle and the wheel; and a blocking member disposed within the passage, wherein the blocking member is movable within the passage between a first position in which the ball bearings can be inserted into the circumferential space via the passage and a second position in which the blocking member prevents the ball bearings from exiting the circumferential space via the passage.

The passage may extend laterally through the axle.

The passage may intersect with the outer circumferential groove at an angle ranging between about 60 and 120 degrees.

The first position may be a radially inward position of the blocking member with respect to the axle, and the second position may be a radially outward position of the blocking member with respect to the axle.

The blocking member may comprise a groove forming a portion of the outer circumferential groove of the axle when the blocking member is in the second position.

The axle may further comprise a first retaining feature extending along the passage, the blocking member may comprise a second retaining feature, and the first retaining feature and the second retaining feature may engage to retain the blocking member within the passage while permitting the blocking member to move along the passage between the first position and second position. The wheel assembly may further comprise a fastener connected to the blocking member when the blocking member is in the second position, and the fastener may engage the axle to prevent the blocking member from moving along the passage from the second position to the first position.

The wheel assembly may further comprise a fastener engaging both the blocking member and the axle when the blocking member is in the second position to prevent the blocking member from moving along the passage from the second position to the first position. The fastener may be a threaded fastener comprising a head and a threaded shank, and the threaded shank may threadedly engage the blocking member and the head may contact the axle to prevent the blocking member from moving along the passage from the second position to the first position.

The present disclosure also introduces a method comprising assembling a wheel assembly (e.g., operable to reduce friction between a downhole tool and a surface of a wellbore to facilitate downhole conveyance of the downhole tool), wherein assembling the wheel assembly comprises: disposing a wheel around an axle to form a circumferential (e.g., substantially torus-shaped or otherwise toroidal) space between the wheel and the axle, wherein a passage extends through the axle and connects with the circumferential space; inserting ball bearings into the circumferential space via the passage; moving a plug along the passage to an end of the passage to close off the circumferential space from the passage to prevent the ball bearings from exiting the circumferential space via the passage; and fastening the plug to the axle with a fastener.

The wheel assembly may further comprise a fastener, and the method may further comprise inserting the fastener at least partially into a sidewall of the downhole tool to connect the wheel assembly to the downhole tool.

The ball bearings may reduce friction between the axle and the wheel and prevent separation of the wheel from the axle.

Moving the plug along the passage may comprise sliding the plug along the passage from a first position in which the ball bearings can be inserted into the circumferential space via the passage and a second position in which the plug is located at the end of the passage.

Moving the plug along the passage may comprise sliding the plug along the passage from a radially inward position with respect to the axle in which the ball bearings can be inserted into the circumferential space via the passage to a radially outward position with respect to the axle in which the plug is located at the end of the passage.

The axle may further comprise a retaining feature extending along the passage, and moving the plug along the passage may comprise sliding the plug along the retaining feature to retain the plug within the passage while sliding the plug along the passage.

Fastening the plug to the axle with the fastener may comprise inserting the fastener at least partially through the plug and the axle.

Fastening the plug to the axle with the fastener may comprise: inserting a head of the fastener into a cavity extending into the axle and intersecting the passage; and while the head is in the cavity, threadedly engaging a threaded shank of the fastener with a threaded bore extending into the plug.

The axle may further comprise: a circumferential outer surface comprising the outer circumferential groove; and an outer face surface configured to be disposed against the downhole tool, wherein the passage may extend through the axle between the outer face surface and the circumferential outer surface.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a wheel assembly configured to detachably connect to a downhole tool to thereby reduce friction between the downhole tool and a sidewall of a wellbore through which the downhole tool is conveyed, wherein the wheel assembly comprises:

an axle configured to contact a sidewall of the downhole tool, wherein the axle comprises a plurality of bores extending therethrough;

a wheel rotatably connected to the axle such that the wheel extends around at least a portion of the axle and the plurality of bores; and a plurality of fasteners each configured to be disposed at least partially within a corresponding bore of the plurality of bores and extend out of that bore into the sidewall of the downhole tool to detachably connect the axle to the downhole tool.

2. The apparatus of claim 1 wherein each fastener of the plurality of fasteners comprises a threaded fastener configured to threadedly engage a corresponding threaded bore extending into the sidewall of the downhole tool to detachably connect the axle to the downhole tool.

3. The apparatus of claim 1 wherein the axle comprises a cylindrical geometry.

4. The apparatus of claim 1 wherein the axle comprises a cylindrical geometry having a first central axis, wherein each bore of the plurality of bores has a second central axis, and wherein the first central axis and each of the second central axes are parallel.

5. The apparatus of claim 1 wherein the axle comprises:

a first outer face configured to contact the sidewall of the downhole tool;

a second outer face; and an outer circumferential surface extending between the first outer face and the second outer face, wherein each bore of the plurality of bores extends through the axle between the first outer face and the second outer face, and wherein each fastener of the plurality of fasteners is configured to extend out of a corresponding bore of the plurality of bores past the first outer face.

6. The apparatus of claim 5 wherein the first outer face and the second outer face each comprise a circular geometry.

7. The apparatus of claim 5 wherein the circumferential surface comprises a cylindrical geometry.

8. The apparatus of claim 1 wherein the axle comprises an outer diameter, wherein the wheel comprises an outer diameter, and wherein the outer diameter of the wheel is larger than the outer diameter of the axle.

9. An apparatus comprising:

a wheel assembly configured to detachably connect to a downhole tool to thereby reduce friction between the downhole tool and a sidewall of a wellbore through which the downhole tool is conveyed, wherein the wheel assembly comprises:

an axle configured to contact a sidewall of the downhole tool, wherein the axle comprises a plurality of bores extending therethrough, and wherein each bore is configured to accommodate a corresponding fastener; and a wheel rotatably connected with the axle, wherein the wheel comprises a bore extending therethrough, and wherein rotation of the wheel with respect to the axle moves the bore of the wheel one at a time into alignment with each bore of the axle.

10. The apparatus of claim 9 further comprising each corresponding fastener, wherein each corresponding fastener is disposed at least partially within and extending out of a corresponding bore of the plurality of bores of the axle, and wherein each corresponding fastener is configured to extend into the sidewall of the downhole tool to detachably connect the axle to the downhole tool.

11. The apparatus of claim 10 wherein each corresponding fastener comprises a bolt having external threads, and wherein each corresponding fastener is configured to threadedly engage a corresponding threaded bore of the downhole tool to connect the axle to the downhole tool.

12. The wheel assembly of claim 9 wherein the bore of the wheel is configured to accommodate each corresponding fastener therethrough when the bore of the wheel is aligned with one of the bores of the axle.

13. The apparatus of claim 9 wherein the bores of the axle and the bore of the wheel are each offset from an axis of rotation of the wheel.

14. An apparatus comprising:

a wheel assembly configured to detachably connect to a downhole tool to thereby reduce friction between the downhole tool and a sidewall of a wellbore through which the downhole tool is conveyed, wherein the wheel assembly comprises:

an axle comprising:

a first outer face configured to contact a sidewall of the downhole tool;

a second outer face;

an outer circumferential surface extending between the first outer face and the second outer face; and a plurality of bores each extending through the axle between the first outer face and the second outer face;

a wheel rotatably connected to the axle such that the wheel extends around at least a portion of the axle and the plurality of bores; and a plurality of fasteners each configured to be disposed at least partially within a corresponding bore of the plurality of bores and extend out of that bore past the first outer face and into the sidewall of the downhole tool to detachably connect the axle to the downhole tool.

15. The apparatus of claim 14 wherein each fastener of the plurality of fasteners comprises a threaded fastener configured to threadedly engage a corresponding threaded bore extending into the sidewall of the downhole tool to detachably connect the axle to the downhole tool.

16. The apparatus of claim 14 wherein the axle comprises a cylindrical geometry.

17. The apparatus of claim 14 wherein:

the axle comprises a cylindrical geometry having a first central axis;

each bore of the plurality of bores has a second central axis; and the first central axis and each of the second central axes are parallel.

18. The apparatus of claim 14 wherein the first outer face and the second outer face each comprise a circular geometry.

19. The apparatus of claim 14 wherein the circumferential surface comprises a cylindrical geometry.

20. The apparatus of claim 14 wherein:

the axle comprises an outer diameter;

the wheel comprises an outer diameter; and the outer diameter of the wheel is larger than the outer diameter of the axle.

* * * * *